US006336757B1

(12) United States Patent
Nishimura et al.

(10) Patent No.: US 6,336,757 B1
(45) Date of Patent: Jan. 8, 2002

(54) LABEL PRINTER

(75) Inventors: Hiromu Nishimura; Tetsuji Inoue, both of Shiga (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 09/513,825

(22) Filed: Feb. 25, 2000

(30) Foreign Application Priority Data

Mar. 1, 1999 (JP) ..... 11-053387

(51) Int. Cl.[7] ..... B41J 11/48

(52) U.S. Cl. ..... 400/613; 400/691; 242/578; 226/192

(58) Field of Search ..... 400/613, 618, 400/691, 692, 693; 101/228, 288; 242/578, 578.3, 597.3; 226/137, 141, 191, 192, 117, 19

(56) References Cited

U.S. PATENT DOCUMENTS

| | | | | |
|---|---|---|---|---|
| 1,885,613 A | * | 11/1932 | Littell | |
| 3,022,024 A | * | 2/1962 | Tishken | 242/110.1 |
| 4,027,590 A | * | 6/1977 | Seidl et al. | 101/288 |
| 5,443,319 A | * | 8/1995 | Sugiura et al. | 400/250 |
| 5,562,034 A | * | 10/1996 | Fox | 101/228 |
| 5,564,846 A | * | 10/1996 | Katsumata | 400/611 |
| 5,587,044 A | * | 12/1996 | Goto | 156/577 |
| 5,653,542 A | * | 8/1997 | Sugimoto et al. | 400/248 |
| 5,771,803 A | * | 6/1998 | Takami | 101/128.21 |
| 6,116,796 A | * | 9/2000 | Yamaguchi et al. | 400/615.2 |
| 6,164,203 A | * | 12/2000 | Keller | 101/407.1 |

FOREIGN PATENT DOCUMENTS

JP 2-9983 3/1990

OTHER PUBLICATIONS

Webster's Ninth New Collegiate Dictionary, p. 70.*

* cited by examiner

*Primary Examiner*—Ren Yan
*Assistant Examiner*—Kevin D. Williams
(74) *Attorney, Agent, or Firm*—Staas & Halsey LLP

(57) ABSTRACT

A label printer for printing predetermined data on and issuing labels includes a tubular roll holder (101) secured at one end to a vertical wall (11*a*), a slide member (102) slidably accommodated within the hollow of the roll holder (101), and a roll retaining lever (103) connected to the slide member 102for pivotal movement between folded and erected positions. The roll retaining lever (103) has one end portion (103*a*) protruding outwardly from the hollow of the roll support shaft through a slot (101*a*) defied in the roll holder (101) in communication with the hollow thereof, when the roll retaining lever (103) is pivoted to the erected position, to thereby retain a roll (R) of the ribbon-shaped label sheet (Rp) in position on the roll holder (101) to avoid any possible lateral displacement thereof, but the roll retaining lever (103) when in the folded position lies substantially parallel to a longitudinal axis of the roll holder (101) to allow the label roll (R) to be mounted onto the roll holder (101). By this design, not only can the label roll (R) be retained in position on the roll holder (101) within a label supply unit (100) to avoid any possible lateral displacement thereof along the roll holder (101), but also the position at which the roll retaining lever (101) is to be erected can be adjusted. Also, the label roll (R) can be quickly and easily mounted on the roll holder (101).

8 Claims, 16 Drawing Sheets

LABEL PRINTER

BACKGROUND OF THE INVENTION

1. Field of the Invention

The present invention generally relates to a label printer for printing and issuing labels of a kind bearing thereon data such as a product name, price, "Best Before" date (a recommended relishable date) and/or any other data associated with the product on which the label is affixed.

2. Description of the Prior Art

Label printers for printing and issuing labels are currently largely employed in a variety of industries. In general, the label printers are of a design wherein a ribbon of label carrier sheet carrying a row of blank labels adhering peelably to the label carrier sheet is utilized and the blank labels are successively printed and issued with data printed thereon. The data to be printed on each blank label include, for example, product name, price, "Best Before" date (a recommended relishable date) and/or any other data associated with the product on which the eventually printed label is affixed.

By way of example, the Japanese Utility Model Publication No. 2-9983 discloses the label printer including a label supply unit accommodating therein a roll of ribbon-shaped label carrier sheet comprising a ribbon of backing sheet and a row of closely adjoining blank labels each adhering at an adhesive side thereof to the backing sheet, and a printer unit including a platen roll and a printer head. The ribbon-shaped label carrier sheet is successively drawn out from the label supply unit towards a printing station at which as the ribbon-shaped label carrier sheet is intermittently supplied through a nip region between the platen roll and the printer head, required or desired items of data are printed by the printer head on each label.

The prior art label printer of the type discussed above makes use of a roll holder for rotatably supporting the roll of the ribbon-shaped label carrier sheet. More specifically, as shown in FIG. 17, the roll holder employed in the prior art label printer comprises a support bar B having one end rigidly secured to a vertical wall lying parallel to the direction of transport of the ribbon-shaped label carrier sheet, and a retainer member C mounted detachably on the support bar B for retaining the label roll D of the ribbon-shaped label carrier sheet in position between the vertical wall A and the retainer member C. The retainer member C used therein is of a configuration including a boss C1 and a flange C2 of a diameter larger than the diameter of the support bar B.

While the label roll D is rotatably supported on the support bar B, the retainer member C is mounted on the support bar B with an end face C2' of the flange C2 held in sliding contact with the adjacent end of the label roll D to thereby avoid a lateral displacement of the label roll D along the support bar B and, hence, to prevent the label roll D from being laterally separating out of the support bar B when the ribbon-shaped label carrier sheet is drawn out from the label roll D. To avoid any possible displacement of the retainer member C in a direction axially of the support bar B, the retainer member C can be fixed in position by fastening a stopper screw E once the retainer member C is set in position on one side of the label roll D.

A similar roll holder, but having a different structure such as shown in FIG. 18, is also largely utilized. As shown in FIG. 18, the roll holder includes a support bar F having a free end face, and a generally C-shaped, thin retainer member G having one end connected to the free end face of the support bar F for pivotal movement between folded and operative positions. When the label roll H is to be mounted on the support bar F, the retainer member G is held in the folded position in which the retainer member G is encompassed within the perimeter of the free end face of the support bar F as shown to allow passage of the label roll H over and onto the support bar F. Once the label roll H has been mounted on the support bar F, the retainer member G is pivoted to the operative position, shown by the phantom line, to overlap with the adjacent end face of the roll H to thereby prevent the label roll H from being displaced axially of the support bar F.

According to the previously mentioned publication discussed with reference to FIG. 17, the retainer member C makes use of the stopper screw E which, when fastened, allows the retainer member C to be fly positioned at the very location at which the stopper screw E is fastened. Accordingly, by repositioning the retainer member C on the support bar B and then fastening the stopper screw E, the roll holder is capable of accommodating label rolls of different axial lengths, that is, label carrier ribbons of different widths, one at a time.

However, when the label roll D is desired to be replaced with a different label roll of the same or different axial length, the roll holder of the structure shown in FIG. 17 requires a series of jobs of undoing the stopper screw E with the use of a screw driver or the like to allow the retainer member C to be removed from the support bar B, re-mounting the retainer member C onto the support bar B after the label roll D has been replaced with the different label roll, and fastening the stopper screw E again with the use of the screw driver. This is cumbersome and time-consuming and, therefore, replacement of the label rolls is indeed inefficient.

On the other hand, with the roll holder of the structure shown in FIG. 18, replacement of the label roll H with the different label roll can be efficiently carried out since removal of the label roll H and mounting of the different label roll can be accomplished by merely pivoting the retainer member G between the folded and operative positions. However, fitting of the retainer member G to the free end face of the support bar F involves the following problems.

More specifically, the retainer member G secured to the free end face of the support bar F is incapable of being moved in a direction axially of the support bar F. Accordingly, the retainer member G cannot be repositioned according to the axial length of the label roll H and, hence, the roll holder of FIG. 18 is incapable of accommodating the label carrier ribbons of different widths one at a time.

Also, since the folded position for the retainer member G must be such that the retainer member G is encompassed within the perimeter of the free end face of the support bar F to allow the label roll H to be mounted onto the support bar F without being obstructed by the retainer member G, the radial distance shown by h in FIG. 18, measured between the point of pivot of the retainer member G and a free end of the retainer member G remote from the point of pivot when the retainer member G is pivoted to the operative position, is limited. This means that when the label roll of a relatively large diameter, that is, having a radius greater than the radial distance h is mounted on the support bar F, an outer peripheral portion of the label roll H will protrude radially outwardly from the retainer member G in the operative position and, therefore, the retainer member G will be incapable of retaining the label roll H in the right shape. More specifically, if some of outer turns of the label roll H are loosened while the label carrier ribbon is drawn out from the label roll H, the retainer member G is unable to retain such some of the outer turns of the label roll H substantially in flush with the opposite end face of the remaining label roll H and will, therefore, be separated from the remaining turns of the label roll H.

SUMMARY OF THE INVENTION

Accordingly, the present invention has been devised with a view to substantially eliminating the above discussed problems inherent in the prior art label printers and is intended to provide an improved label printer wherein not only can the label roll of a varying diameter can be assuredly kept in position on a support bar, but also the label roll of any different diameter can be mounted on the support bar easily and quickly.

To this end, the present invention provides a label printer for printing predetermined data on and issuing labels, which printer includes a roll supply unit adapted to accommodate a roll of ribbon-shaped label sheet; a vertical wall disposed along and perpendicular to a predetermined path of travel of a ribbon of label sheet drawn outwardly from the roll in the roll supply unit; a tubular roll support shaft having a hollow defined therein and connected to the vertical wall so as to extend perpendicular thereto, said roll support shaft having a slot defined therein in communication with the hollow thereof; a slide member movably accommodated within the hollow of the roll support shaft for movement in a direction axially of the roll support shaft; and a lever member connected to the slide member for pivotal movement about a point of pivot between folded and erected positions relative to the roll support shaft.

The lever member when in the erected position has one end portion protruding outwardly from the hollow of the roll support shaft through the slot, to thereby retain the roll of the ribbon-shaped label sheet in position on the roll support shaft to avoid any possible lateral displacement thereof. On the other hand, the lever member when in the folded position lies substantially parallel to a longitudinal axis of the roll support shaft to allow the roll of the ribbon-shaped label sheet to be mounted onto the roll support shaft.

Preferably, the lever member has the opposite end portion extending away from the point of pivot in a direction counter to said one end portion thereof so that when the lever member is pivoted to the erected position, such opposite end portion of the lever member can be brought into press-contact or engagement with an inner wall surface of the roll support shaft to thereby lock the lever member at the erected position.

Also preferably, the slide member has a thickened wall portion engageable with a side face of an opposite end portion of the lever member when the lever member is pivoted to the erected position, so that said thickened wall portion when brought into engagement with the side face of the opposite end portion of the lever member can expand the slide member to bring an outer wall face of the slide member into contact with an inner wall surface of the roll support shaft to thereby lock the lever member at the erected position.

Yet preferably, the slide member has side walls opposite to each other and has a slit defined in each of the side walls so as to extend away from the vertical wall, so that the slit in each of the side walls can divide the corresponding side wall into two wall segments, at least one of said wall segments having a resiliency. In this arrangement, the at least one of the wall segments is formed with a projection for urging an inner wall surface of the roll support shaft and, accordingly, when the slide member slides within the hollow of the roll support shaft, a slide resistance of a predetermined magnitude is developed between the projection and the inner wall surface of the roll support shaft.

In a preferred embodiment of the present invention, the lever member has an index marking alignable with one end face of the roll of the ribbon-shaped label sheet when the roll is mounted on the roll support shaft, to thereby indicates a position of the lever member at which the lever member is pivoted to the erected position to retain the roll in position on the roll support shaft.

In another preferred embodiment of the present invention, the lever member and the slide member are integrally assembled into a single lever unit whereby the lever member and the slide member can be mounted inside the roll support shaft by inserting the lever unit axially into the hollow of the roll support shaft.

Furthermore, in a further preferred embodiment of the present invention, the slide member includes a third wall disposed between opposite side walls thereof, said third wall having two parallel slits defined therein so as to extend in a direction inwardly thereof and away from the vertical wall so as to define an isolated portion discontinued from the opposite side walls thereof and having a resiliency. In this design, the isolated portion having an outer surface formed with an engagement protruding outwardly therefrom is engageable with one end of the slot in the roll support shaft adjacent the vertical wall after the single lever unit is mounted into the hollow of the roll support shaft, to thereby retain the single lever unit therein while being prevented from detachment out of the hollow by means of the engagement engaged with the end of the slot in the roll support shaft adjacent the vertical wall.

According to the label printer embodying the present invention, merely by erecting the lever member relative to the roll support shaft, an undesirable lateral displacement of the label roll along the roll support shaft can advantageously and conveniently suppressed.

Accordingly, when the label roll is to be mounted onto the roll support shaft, no job of undoing and fastening the screw member such as required in the prior art label printer is required in the present invention and, merely by erecting the lever member in the manner described above, the label roll can easily and quickly mounted onto the roll support shaft. Therefore, the efficiency with which the label roll is mounted can be increased advantageously.

Also, since the slide member is so designed as to be slidable within the hollow of the roll support shaft, the position at which the lever member is to be erected can be adjusted according to the axial length of the label roll, that is, the width of the label carrier sheet forming the label roll.

Again, since when the lever member is folded, i.e., brought to the folded position, the lever member extends substantially parallel to the longitudinal axis of the roll support shaft, mounting of the label roll onto the roll support shaft will not be obstructed by the lever member even though that end portion of the lever member that protrudes outwardly from the roll support shaft through the slot has a substantial length. Accordingly, that end portion of the lever member can have an increased length so that the lever member when in the erected position protrudes a correspondingly increased distance outwardly from the roll support shaft and can therefore accommodate an increased radius of the label roll while retaining the label roll of the relatively great radius in position on the roll support shaft without allowing outer turns of the label rolls being loosened. Also, even when the ribbon of the label carrier sheet being drawn out from the label roll floats, some of the outer turns of the label roll will not be loosened.

According to the label printer in which when the lever member is erected relative to the roll support shaft the opposite end portion of the lever member can be brought into engagement with the inner wall surface of the roll support shaft, the lever member can assuredly be locked at the erected position and, therefore, there is no possibility that as the lever member is being erected the lever member may undergo an arbitrary movement about the point of pivot accompanied by displacement of the position at which the lever member is to be erected to retain the label roll on the roll support shaft.

Also, the thickened wall portion engageable with a side face of an opposite end portion of the lever member when the lever member is pivoted to the erected position is formed in the slide member so that the thickened wall portion when brought into engagement with the side face of the opposite end portion of the lever member can expand the slide member to bring an outer wall face of the slide member into contact with an inner wall surface of the roll support shaft to thereby lock the lever member at the erected position. Accordingly, the possibility that as the lever member is being erected the lever member may undergo an arbitrary movement about the point of pivot accompanied by displacement of the position at which the lever member is to be erected to retain the label roll on the roll support shaft can be equally eliminated advantageously.

In the design in which when the lever member is erected the end portion of the lever member extended with respect to the point of pivot is brought into engagement with the inner wall surface of the roll support shaft, erection of the lever member takes place in such a manner that a relatively large force acts on the lever member being pivoted towards the erected position immediately following the point at which that end portion of the lever member is just brought into engagement with the inner wall surface of the roll support shaft. At this time, it may occur that the slide member will move within the hollow of the roll support shaft. However, the employment of the above described design is effective to prevent the slide member from being arbitrarily moved within the hollow of the roll support shaft at the time of erection or folding of the lever member.

Where the projection is formed in the slide member for urging the inner wall surface of the roll support shaft so that the slide resistance of a predetermined magnitude can be developed between the projection and the inner wall surface of the roll support shaft during the sliding motion of the slide member within the hollow of the roll support shaft, the possibility can be eliminated in which an arbitrary movement of the slide member within the hollow of the roll support shaft may result in change in position at which the lever member is to be erected to retain the label roll in position on the roll support shaft. Accordingly, in the event of replacement of one label roll with another label roll having the same axial length as that of such one label roll, no repositioning of the slide member is required after such another label roll is mounted onto the roll support shaft by folding the lever member, and erection of the lever member is sufficient to retain such another label roll in position on the roll support shaft without repositioning the slide member within the hollow of the roll support shaft.

Furthermore, the provision in the lever member of the index marking alignable with one end face of the roll of the ribbon-shaped label sheet when the roll is mounted on the roll support shaft, to thereby indicates a position of the lever member at which the lever member is pivoted to the erected position to retain the roll in position on the roll support shaft, is effective and advantageous in that erection of the lever member after the position indicated by the index marking when the lever member is folded has been aligned with one end face of the label roll can result in the lever member being erected at the exact position at which the label roll is to be retained.

Where, for example, when the lever member is pivoted to the erected position relative to the roll support shaft, the opposite end portion of the lever member is brought into engagement with the inner wall surface of the roll support shaft, a reactive force may be transmitted from the roll support shaft to the lever member to move the slide member within the hollow of the roll support shaft. Once this occurs, the position at which the lever member is to be erected is displaced from the exact position at which the label roll is to be retained, even though the attendant worker has erected the lever member towards the erected position after having aligned with the exact position, and, accordingly, the necessity will occur that the lever member has to be manipulated frequently to pivot it between the erected and folded positions so that the lever member can be erected at the exact position for retaining the label roll. However, the provision of the index marking in the manner described above is effective and advantageous in that the position at which the lever member has to be erected can easily be grasped at a single sight, resulting in increase of the workability.

Where the design is employed in the label printer in which the lever member and the slide member are integrally assembled into a single lever unit so that the lever member and the slide member can be mounted inside the roll support shaft merely by inserting the lever unit axially into the hollow of the roll support shaft, mounting of the lever member and the slide member into the hollow of the roll support shaft can be facilitated. Also, while the slot is defined in the roll support shaft within which the lever member can pivot between the folded and erected position, the single lever unit can be inserted into the hollow of the roll support shaft from one end thereof adjacent the vertical wall and, therefore, the end of the roll support shaft opposite to such one end can be formed integrally with side walls except for a portion thereof forming a part of the path of pivotal movement of the lever member, thereby securing a sufficient rigidity of the roll support shaft.

According to the present invention, when the single lever unit is inserted into the hollow of the roll support shaft, the projection integral with the slide member is brought into engagement with one end of the slot in the roll support shaft to thereby avoid any possible axial detachment of the slide member from the roll support shaft. This design is effective in that when the single lever unit is to be inserted into the hollow of the roll support shaft, the attendant worker can feel a positive sound of reaction from the lever unit, indicating that the single lever unit has been assuredly mounted inside the hollow of the roll support shaft.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
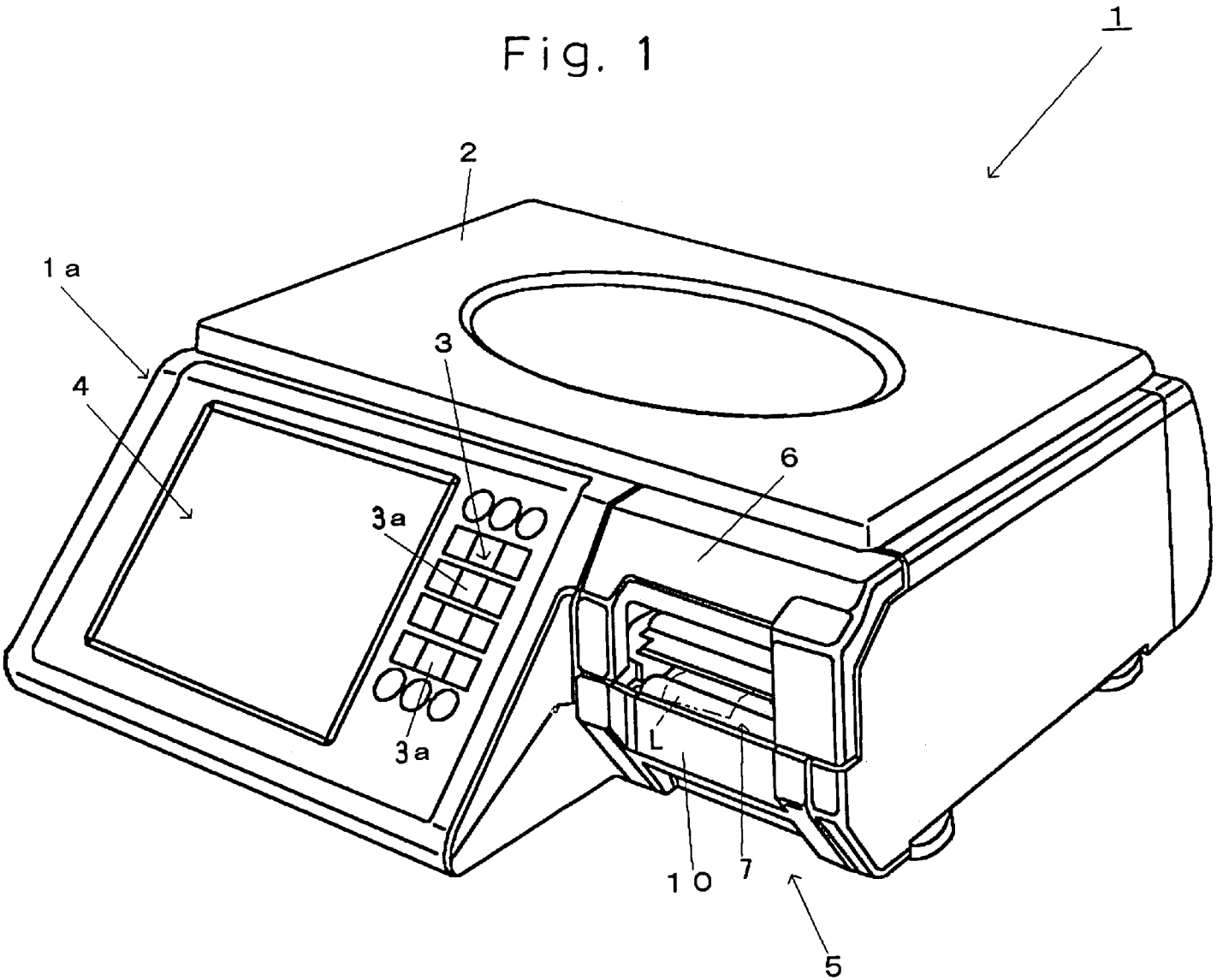
FIG. 1 is a schematic perspective view of a label printer embodying the present invention, showing an outer appearance thereof.

Referring to FIG. 1, a label printer 1 embodying the present invention is shown as incorporated in and, therefore, integrated together with an electronic scale. The illustrated combination scale and printer includes a weighing plate 2 and is so designed that when a product desired to be measured is placed on the weighing plate 2, not only can the weight of the product be measured, but the net weight and the price of the product can also be calculated based on the measured weight of the product.

The combination scale and printer, hereinafter referred to as a label printer 1, also includes an operating panel 3 having a plurality of function keys generally identified by 3*a* and a display window 4 for providing visual presentation of various pieces of information such as data printed on each label and that of operation messages. Designation of products and change and/or registration of data to be printed can be accomplished by manipulating some of the function keys 3*a* on the operating panel 3 and are displayed on the display window 4.

The label printer 1 comprises a housing 1*a* having a right-hand portion, as viewed from front thereof, in which a cassette storage 5 is defined for removably accommodating a cassette 10 with which a label roll is mounted in the label printer 1 in a manner as will be described later. Not only can the cassette 10 accommodating therein the label roll be completely removed from the cassette storage 5, but when the cassette 10 is drawn forwards relative to the housing 1*a*, a cover 6 can be opened in response to forward drawing of the cassette 10. An operator can have an access to the interior of the cassette 10 for mounting of a label carrier ribbon, that is, a web of ribbon-shaped label carrier sheet. This cover 6 can be automatically closed as the cassette 10 once drawn forwards is retracted into the cassette storage 5. Although not shown, a printer head is fitted to an inner surface of the cover 6 so that when the cover 6 is closed after the cassette 10 has been placed inside the cassette storage 5, the printer head can be positioned at a predetermined printing position at which an actual printing takes place.

Figure 2:
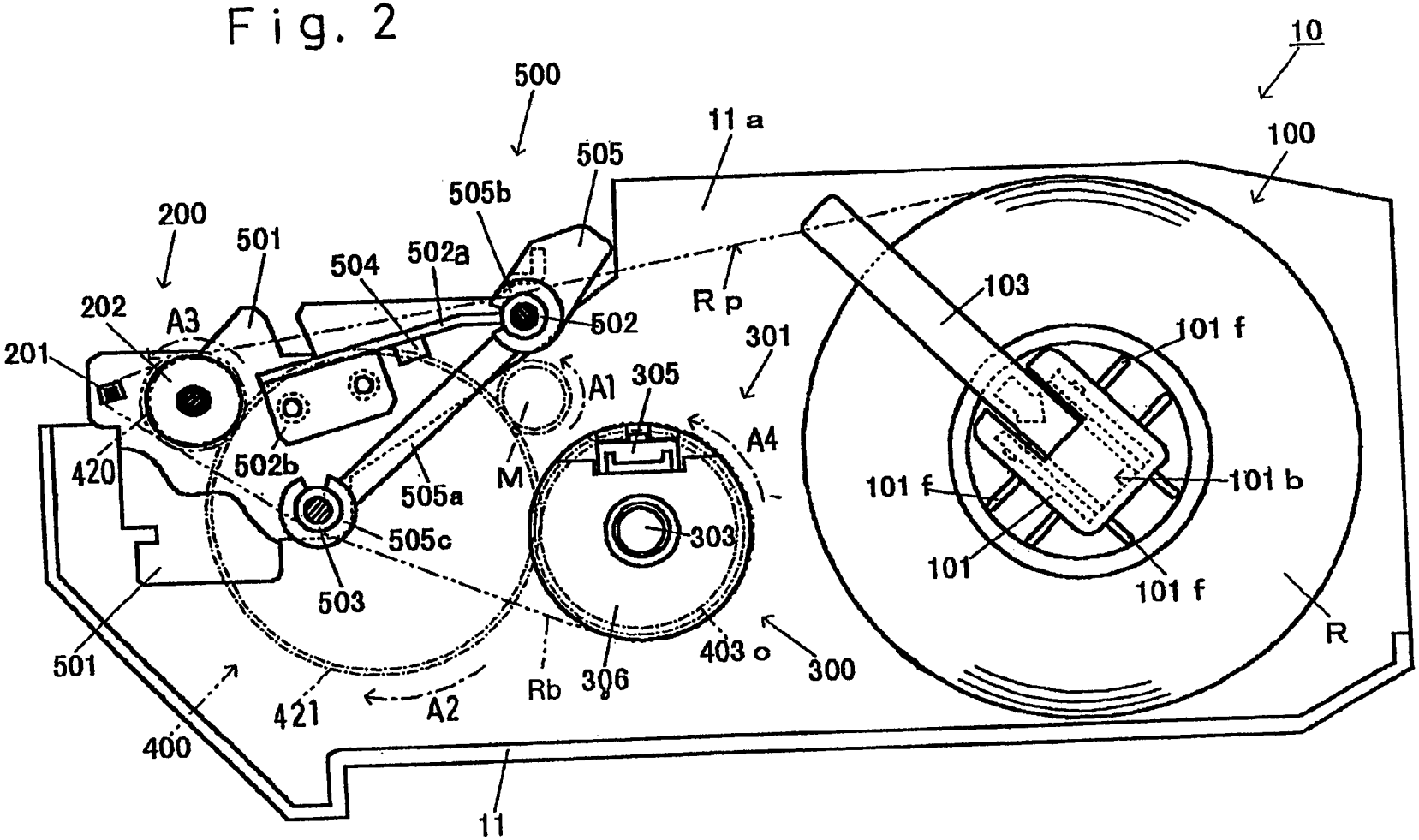
FIG. 2 is a front sectional view of a cassette that is used in the label printer shown in FIG. 1.

As best shown in FIG. 2, the cassette 10 includes a generally L-shaped frame 11 having a vertical wall 11*a* secured to the frame 11. This cassette 10 also includes a label supply unit 100, a printer unit 200 and a sheet take-up unit 300, all of which are defined on one side of the vertical wall 11*a* opposite to the housing 1*a*. The label supply unit 100 is used to support a label roll R of the label carrier ribbon Rp; the printer unit 200 is used to print the required or desired items of data including, for example, the name, price and "Best Before" date of a product; and the sheet take-up unit 300 is used to wind up a web of backing sheet Rb from which labels have been removed.

As will be described later, a drive transmission mechanism 400 including a train of gears for driving a printing roller is mounted on the vertical wall 11*a* and positioned on one side of the vertical wall 11*a* adjacent the housing 1*a*. The drive transmission mechanism 400 is used to transmit a drive from an electric drive motor (not shown) disposed inside the housing 1*a* to various members such as disposed inside the label supply unit 100 referred to hereinabove.

The web of the label carrier ribbon Rp is drawn from the label roll R accommodated within the label supply unit 100 and is then supplied onto the printer unit 200 where the required or desired items of data are printed on the label carrier ribbon Rp, particularly on each of blank labels forming the label carrier ribbon Rp together with the backing sheet Rb. After the predetermined items of data have been printed on the label carrier ribbon Rp, the printed labels on the backing sheet Rb are successively peeled off from the backing sheet Rb by acutely bending the backing sheet Rb around a peel-off rod 201 while the printed labels are allowed to travel linearly away from the backing sheet Rb. The printed labels successively peeled off from the backing sheet Rb then emerge outwardly from a label discharge slot 7 (shown in FIG. 1) and, on the other hand, the backing sheet Rb is wound up in the take-up unit 300.

Figure 3:
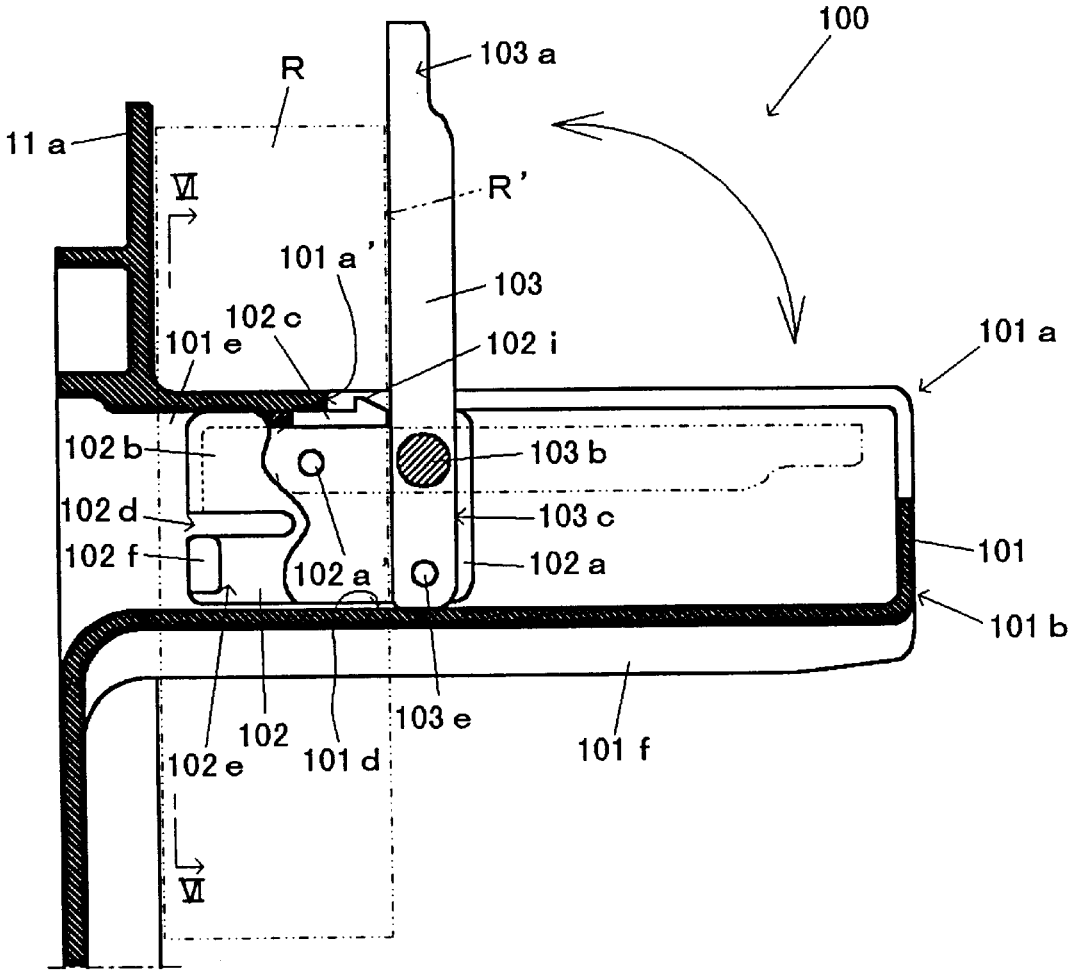
FIG. 3 is a left-hand side sectional view of a label supply unit employed in the cassette shown in FIG. 2.
Figure 4:
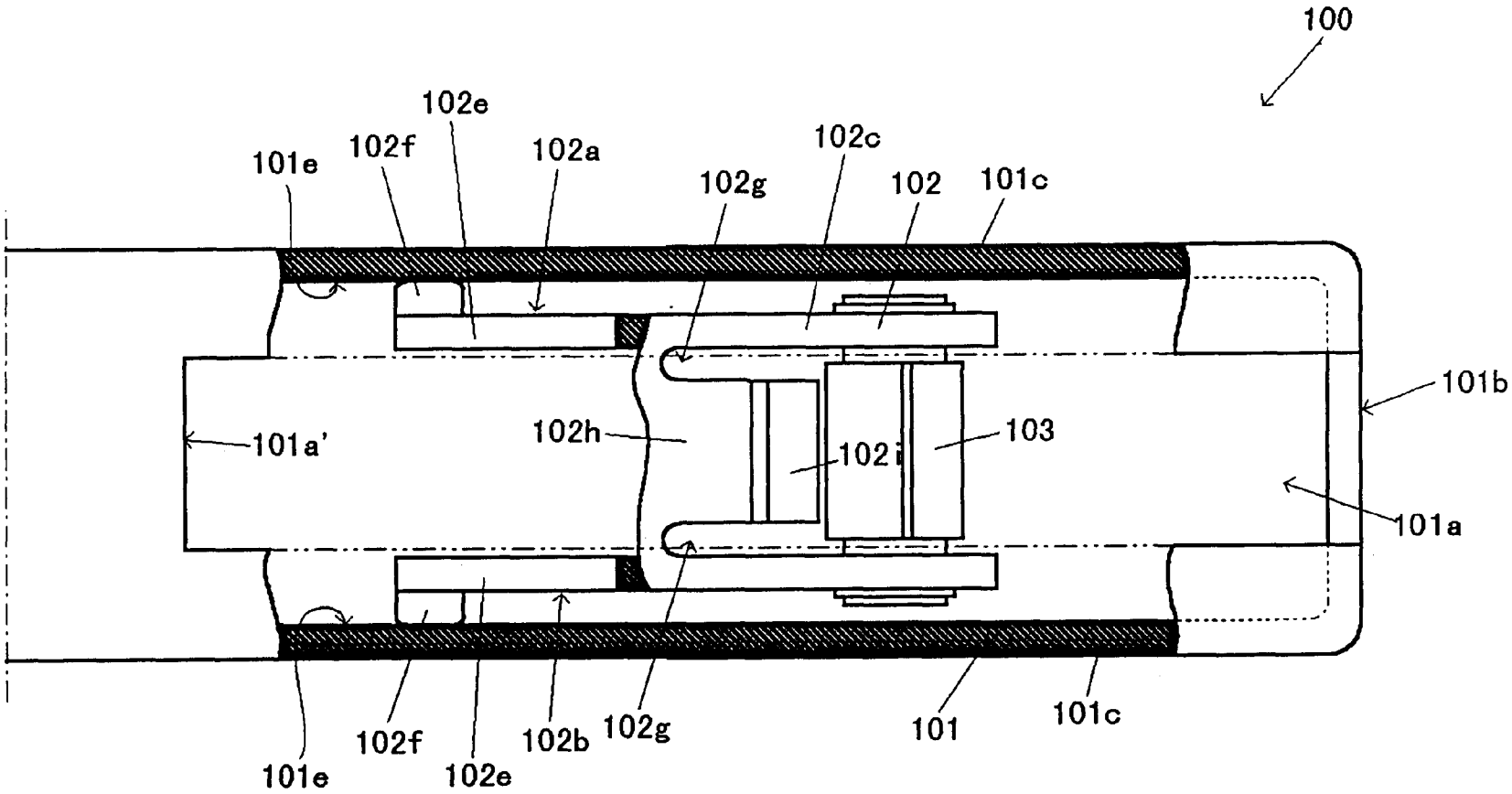
FIG. 4 is a top plan view, with a portion cut out, of the label supply unit shown in FIG. 3.

The label supply unit 100 comprises, as best shown in FIGS. 2 to 4, a roll holder 101 of a generally square cross-section for supporting the label roll R thereon. This roll holder 101 has one end fixedly secured to the vertical wall 11*a* of the cassette 10 so as to extend in a direction perpendicular thereto and is in the form of a generally square-sectioned tubular body having a slot 101*a* defined therein in communication with the hollow of the roll holder 101. A slide member 102 is slidably accommodated within the hollow of the roll holder 101 and includes a roll retaining lever 103 pivotally connected at one end to the slide member 102. This roll retaining lever 103 is pivotable between an erected position, shown by the solid line in FIG. 3, at which the roll retaining lever 103 emerges outwardly of the roll holder 101 through the slot 101*a* and lies perpendicular to the longitudinal sense of the roll holder 101 with a free end 103*a* thereof positioned outside the hollow of the roll holder 101, and a folded position, as shown by the phantom line in FIG. 3, at which the roll retaining lever 103 is accommodated within the hollow of the roll holder 101 and lie substantially parallel to the longitudinal sense of the roll holder.

So long as the roll retaining lever 103 is held in the folded position, the label roll R can be mounted onto the roll holder 101. However, once the label roll R has been mounted on the roll holder 101 and the roll retaining lever 103 is pivoted to the erected position, the label roll R can be retained in position on the roll holder 101 by the roll retaining lever 103 and the vertical wall 1*a* without allowing the label roll R to be displaceable axially along the roll holder 101. Accordingly, not only can the label roll R be simply and easily mounted on the roll holder 101, but the efficiency of a label roll R mounting work can be increased.

Since as hereinabove described the roll retaining lever 103 is so designed and so tailored as to be held in the folded position at which the roll retaining lever 103 is folded within the roll holder 101 and the presence of the roll retaining lever 103 will not therefore provide any obstruction to passage of the label roll R onto the roll holder 101, the roll retaining lever 103 can have an increased length as measured from the point of pivot 103*b* to the free end 103*a*. This means that when the roll retaining lever 103 is held in the erected position, the roll retaining lever 103 can protrude outwardly from the roll holder 101 such a distance that even when the label roll R of a relatively large radius can be mounted on the roll holder 101, an outer peripheral portion of the label roll R does not protrude outwardly beyond the free end 103*a* of the roll retaining lever 103. Thus, the possibility of some of outer turns of the label roll R being loosened while the label carrier ribbon is drawn out from the label roll R can advantageously be eliminated, allowing the label roll R to be retained in the right shape throughout the printing operation. Also, even though some of the outer turns of the label roll R are loosened when the label carrier ribbon Rp is drawn out from the label roll R, there is no possibility that such turns of the label carrier ribbon Rp will ride over the free end 103*a* of the label retaining lever 103 and such some of the outer turns of the label roll R can be retained substantially in flush with the remaining turns of the label roll R.

Figure 5:
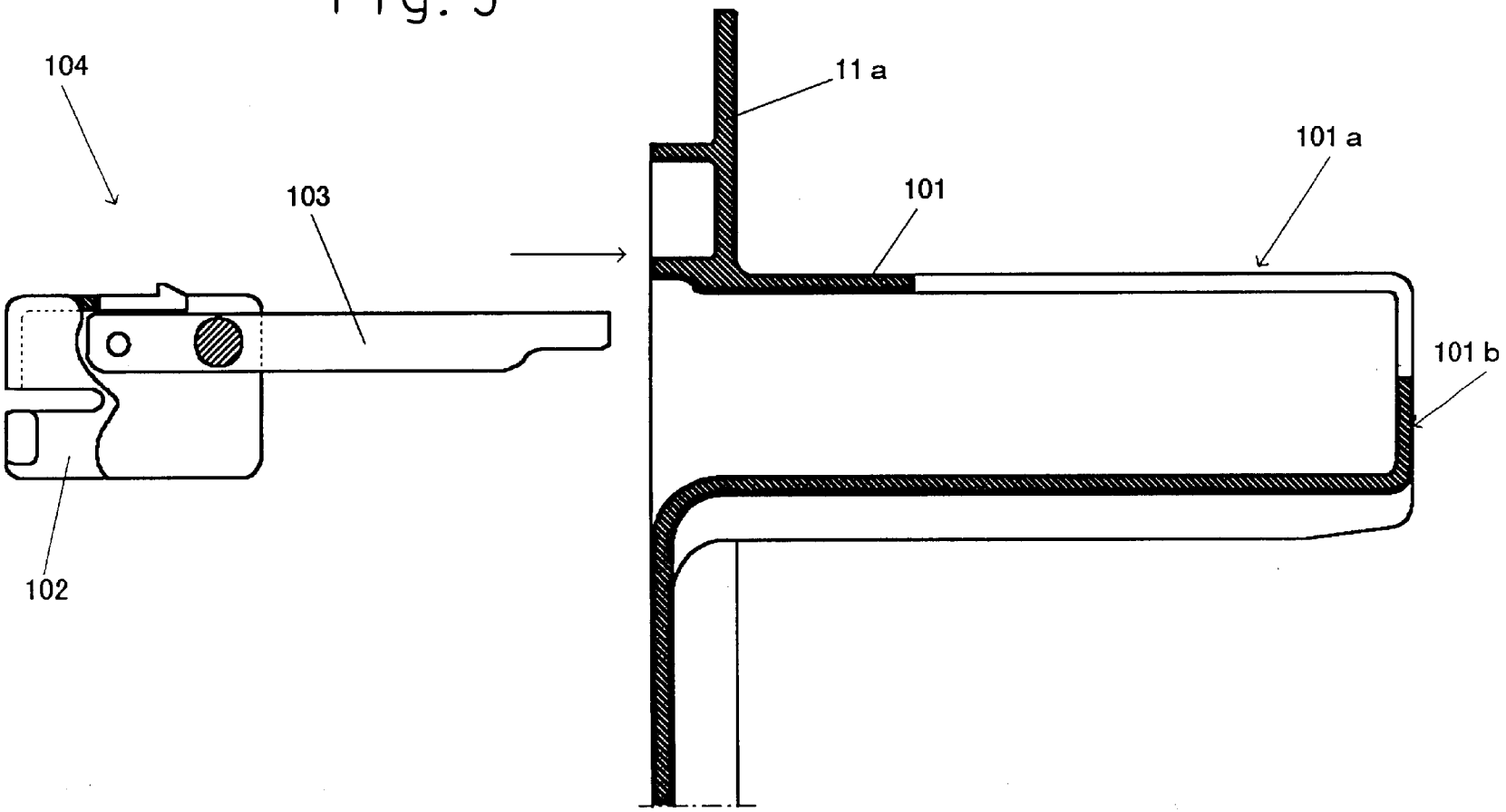
FIG. 5 is an exploded view of the label supply unit, showing the manner in which a lever unit is mounted onto a roll holder.

The slide member 102 and the roll retaining lever 103 are integrally assembled into a lever unit 104. Accordingly, when the slide member 102 and the roll retaining lever 103 are to be mounted, it can easily be accomplished merely by inserting the lever unit 104 axially into the hollow of the roll holder 101 through an opening defined in the vertical wall 11*a* while the roll retaining lever 103 is held in the folded position relative to the slide member 102 as shown in FIG. 5. Thus, it is clear that not only can the roll retaining lever 103 and the slide member 102 mounted easily and quickly in the roll holder 101, resulting in increase of the assembling efficiency, but as shown in FIGS. 2 and 4, an end portion 101*b* of the roll holder 101 remote from the vertical wall 11*a* can also be formed integrally with opposite side walls 101*c*. Accordingly, even though the slot 101*a* is defined in the roll holder 101, the roll holder 101 can have a sufficient rigidity.

The end 103*c* of the roll retaining lever 103 opposite to the free end 103*a* thereof extends beyond the point of pivot 103*b*, at which the roll retaining lever 103 is pivotally connected to the slide member 102, in a direction counter to the free end 103*a* thereof. This end 103*c* of the roll retaining lever 103 is, when the roll retaining lever 103 is pivoted to the erected position as shown in FIG. 3, resiliently urged to contact an inner wall surface 101*d* of the roll holder 101. Accordingly, the contact of the end 103*c* of the roll retaining lever 103 with the inner wall surface 101*d* of the roll holder 101 by the effect of resiliency ensures the roll retaining lever 103 locked in that erected position to thereby avoid any possibility that the roll retaining lever 103 once pivoted to the erected position may arbitrarily displace to depart from the erected position. On the other hand, when the roll retaining lever 103 is forced to move towards the folded position about the point of pivot 103*b*, the roll retaining lever 103 can be released from the locked condition and, with the roll retaining lever 103 eventually held at the folded position, the slide member 102 can freely slide within the hollow of the roll holder 101. Accordingly, by repositioning the slide member 102 within the hollow of the roll holder 101, the position at which the roll retaining lever 103 is pivoted to the erected position can be adjusted according to the axial length of the label roll R, that is, the width of the label carrier ribbon Rp forming the label roll R.

The slide member 102 is made of a material having a resiliency and is of a generally U-shaped section including first and second side walls 102*a* and 102*b* opposite to each other and a third side wall 102*c* defined between the first and second side walls 102*a* and 102*b*. Each of the first and second slide walls 102*a* and 102*b* is formed with a corresponding slit 102*d* extending inwardly from one end thereof adjacent the vertical wall 11*a* in a direction conforming to the longitudinal sense of the roll holder 101, with the respective first or second side wall 102*a* and 102*b* consequently divided partially so as to leave upper and lower wall segments. As shown in FIGS. 3 and 4, one of the wall segments of each of the first and second side walls 102*a* and 102*b*, which is identified by 102*e*, is formed with a respective protuberance 102*f* engageable with a corresponding inner wall surface 101*e* of the roll holder 101. Accordingly, the respective wall segments 102*e* of the first and second side walls 102*a* and 102*b* urge the associated inner wall surfaces 101*e* of the roll holder 101 outwardly through the protuberances 102*f* so that during the sliding movement of the slide member 102 within the hollow of the roll holder 101, a slide resistance of a predetermined magnitude can be generated. Accordingly, the slide member 102 can be prevented from being arbitrarily moved within the hollow of the roll holder 101, but only when the attendant worker desires to move the slide member 102, the slide member 102 can be frictionally moved within the hollow of the roll holder 101. Accordingly, the possibility can be advantageously eliminated that during replacement of one label roll R with a similar label roll having the same axial length as that of the label roll R, the slide member 102 may be arbitrarily displaced from the exact position, or otherwise a fine re-adjustment of the slide member 102 would be required before the roll retaining lever 103 is again pivoted to the erected position to retain the replaced label roll in position on the roll holder 101. Thus, replacement of one label roll R with a similar label roll having the same axial length as that of the label roll R does not require the slide member 102 to be repositioned relative to the roll holder 101 and only erection of the roll retaining lever 103 is required after the replacement.

As shown in FIGS. 3 and 4, the third side wall 102*c* has its outer surface formed with two parallel slits 102*g* defined therein so as to extend inwardly from one end thereof remote form the vertical wall 11*a* wherefore a portion 102*h* of the third side wall 102*c* is discontinued from the first and second side walls 102*a* and 102*b*. The portion 102*h* of the third side wall 102*c* discontinued from the first and second side walls 102*a* and 102*b* has its outer surface formed with a pawl 102*i* that is engageable with one 101*a*' of opposite ends of the slot 101*a* in the roll holder 101 to avoid any possible separation of the slide member 102 being axially separated from the hollow of the roll holder 101. Accordingly, the lever unit 104 comprised of the slide member 102 and the roll retaining lever 103 can be assuredly housed within the hollow of the roll holder 101 without being separated from the roll holder 101 and, at the same time, the attendant worker can feel a positive sound of reaction from the lever unit 104 when the latter is mounted into the hollow of the roll holder 101.

Figure 6:
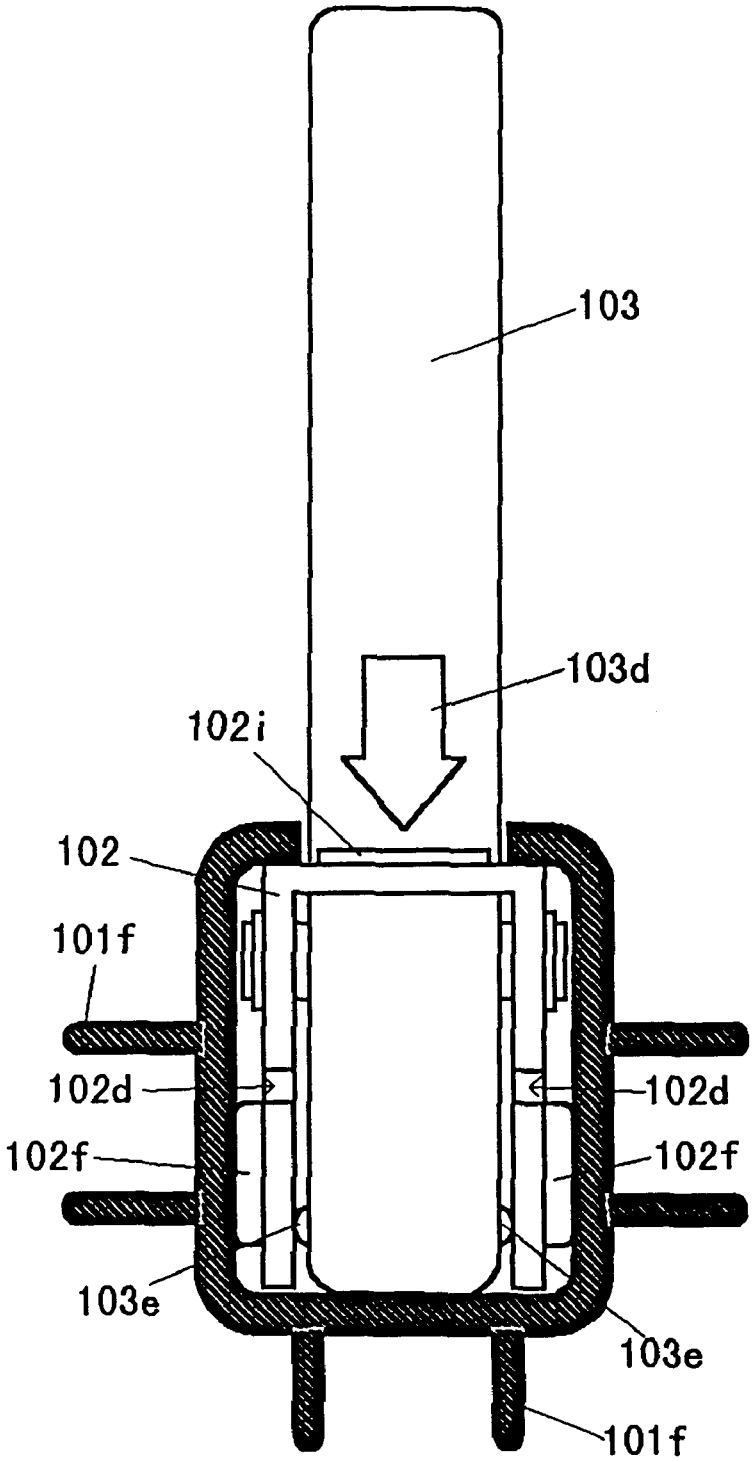
FIG. 6 is a cross-sectional view taken along the line VI—VI in FIG. 3.

As shown in FIG. 6, the roll retaining lever 103 has an arrow marking 103*d* which may be embossed or labeled to provide a visual indication that can be relied on when the roll retaining lever 103 is pivoted to the erected position with respect to the label roll R mounted on the roll holder 101. In other words, when the roll retaining lever 103 is pivoted to the erected position after the label roll R has been mounted onto the roll holder 101 with its end face R' aligned with the position indicated by the arrow marking 103*d* while the roll retaining lever 103 is held at the folded position the roll retaining lever 103 can be assuredly erected at the right position relative to the label roll R to thereby retain the latter in position on the roll holder 101. In such case, in the illustrated embodiment of the present invention that end 103*c* of the roll retaining lever 103 within the hollow of the roll holder 101 is brought into contact with the inner wall surface 101*d* of the roll holder 101 when the roll retaining lever 103 is erected and, accordingly, even though a reactive force is transmitted from the roll holder 101 to the roll retaining lever 103 to move the slide member 102 within the hollow of the roll holder 101, the arrow making 103*d* provides a visual indication of the position of the slide member 103 with the amount of displacement of the slide member 102 within the hollow of the roll holder 101 taken into consideration. Therefore, there is no possibility that the position at which the roll retaining lever 103 is erected is displaced from the right position, which would otherwise require the attendant worker to re-position the roll retaining lever 103 between the erected and folded positions. Thus, the attendant worker can grasp at a single glance the position at which the roll retaining lever 103 is to be erected and, accordingly, the workability can advantageously be increased.

The roll retaining lever 103 is provided with engagement projections 103*e* as shown in FIG. 6 and, on the other hand, the first and second side walls 102*a* and 102*b* of the slide member 102 are formed with engagement recesses 102*a*' and 102*b*' as shown in FIG. 3 in which only one of the engagement recesses that is, the engagement recess 102*a*' is shown. Accordingly, when the roll retaining lever 103 is folded down, that is, pivoted to the folded position, the engagement projections 103*e* are engaged in the respective engagement recesses 102*a*' and 102*b*' to relatively lightly lock the roll retaining lever 103 at the folded position.

It is to be noted that as shown in FIG. 2, the roll holder 101 has an outer peripheral surface formed with a plurality of support members 101*f* protruding generally radially outwardly therefrom so that the label roll R mounted onto the roll holder 101 can be freely rotatably supported on the roll holder 101 through the support members 101*f*.

As shown in FIG. 2, the printer unit 200 includes a platen roll 202 for feeding a web of label carrier ribbon Rp from the label roll R supported on the roll holder 101, and a peel-off rod 201 disposed downstream of the platen roll 202 with respect to the direction of feed of the web of label carrier ribbon Rp and providing an arched path for the web of label carrier ribbon Rp. As hereinbefore described, when the cover 6 is closed with the cassette 10 placed inside the cassette storage 5, the printer head is set to a predetermined position so that the printer head can cooperate with the platen roll 202 to effectuate printing of data on the blank label in the web of label carrier ribbon Rp.

The web of label carrier ribbon Rp fed by the platen roll 202 is subsequently fed in between the platen roll 202 and the printer head, whereat items of data such as product name and its price are printed by the printer head on the blank labels forming the web of label carrier ribbon Rp. During the continued feed of the web of label carrier ribbon Rp and subsequent to the printing of the items of data, the web of label carrier ribbon Rp is sharply bend around the peel-off rod 201 to allow the printed label L to separate from the ribbon of backing sheet Rb. As the printed label L is separated from the ribbon of backing sheet Rb, the printed label L progressively emerges outwardly from the label discharge slot 7. At the same time, the ribbon of backing sheet Rb from which the printed label L has been separated is would up onto the sheet take-up unit 300.

Figure 7:
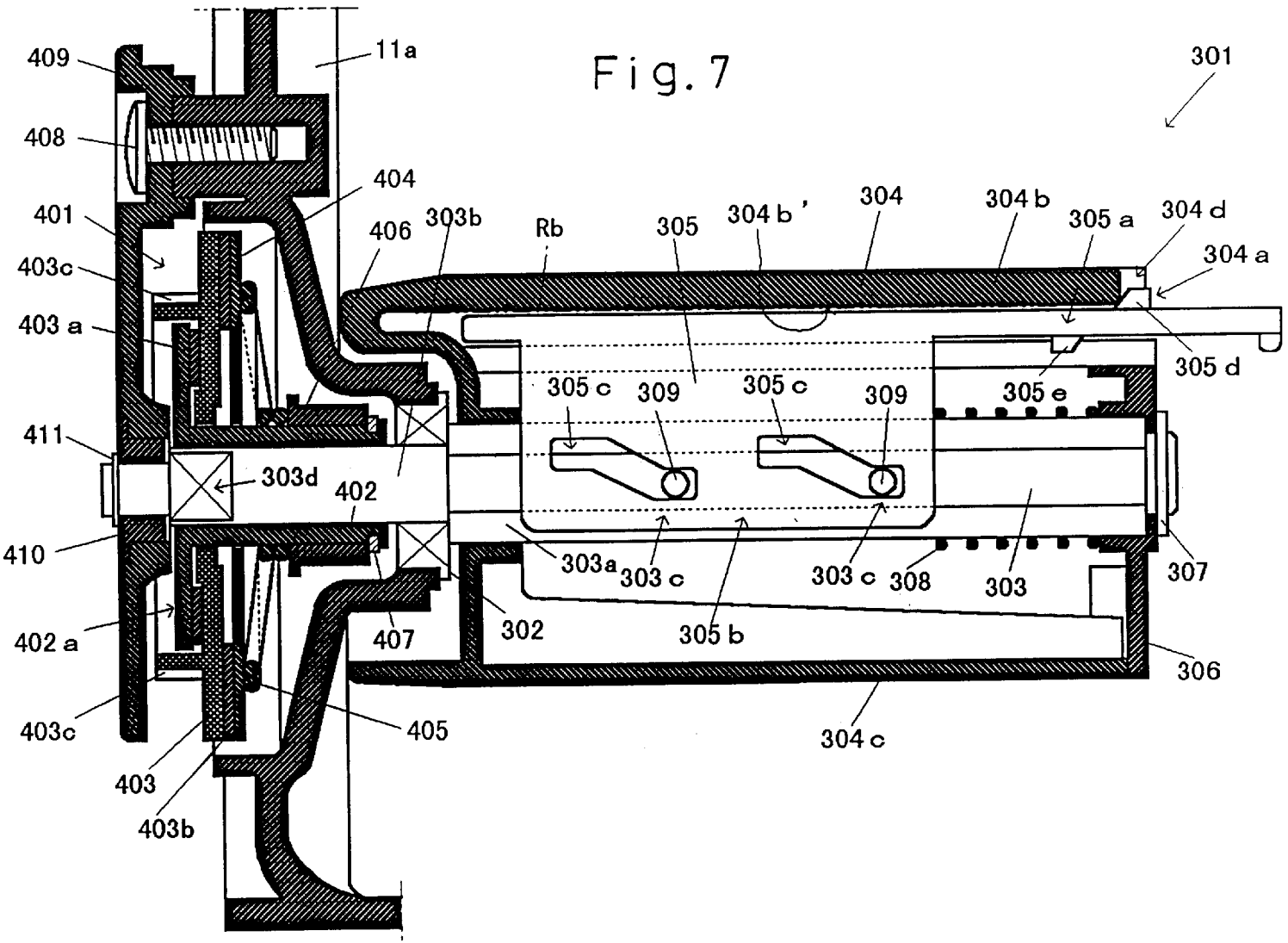
FIG. 7 is a longitudinal sectional view showing a bobbin and a slide clutch.
Figure 8:
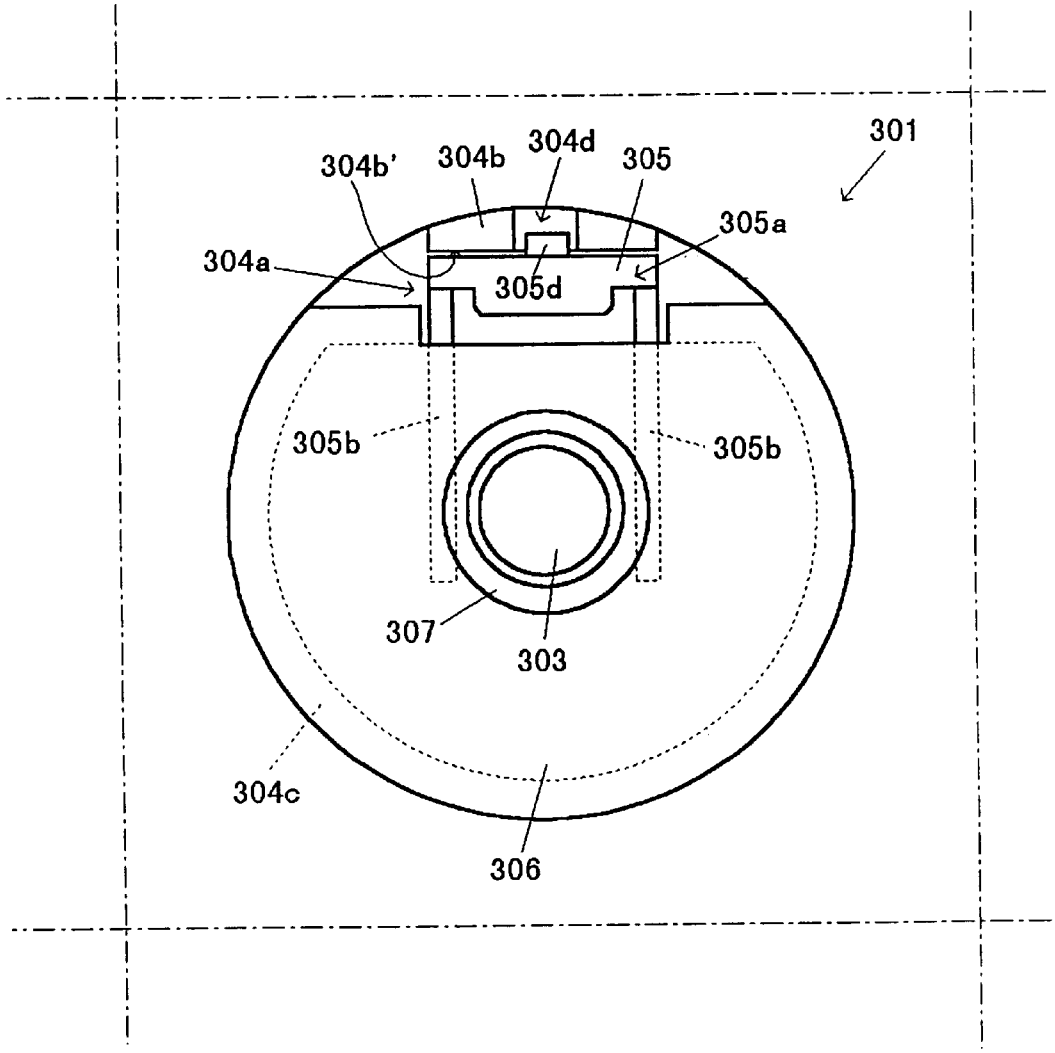
FIG. 8 is a front elevational view of the bobbin.

As best shown in FIGS. 7 and 8, the sheet take-up unit 300 includes a bobbin 301 capable of clamping a leading end of the ribbon of backing sheet Rb and of winding the ribbon of backing sheet Rb therearound during rotation thereof Referring particularly to FIGS. 7 and 8, the bobbin 301 includes a shaft member 303 rotatably supported by the vertical wall 11*a* through a bearing 302, a generally cylindrical hollow bobbin body 304 supported on the shaft member 303, and a lever member 305 movably interposed between the hollow bobbin body 304 and the shaft member 303.

The shaft member 303 has a hexagonal portion 303*a* for supporting the hollow bobbin body 304, and a cylindrical portion 303*b* coupled with a slide clutch 401. The shaft member 303 and the hollow bobbin body 304 are rotated together with each other when a drive of an electric drive motor is transmitted thereto through the slide clutch 401.

The hollow bobbin body 304 is formed with a slit 304*a* that extends inwardly from one end thereof remote from the vertical wall 11*a*, which slit 304*a* divides a portion of the hollow bobbin body 304 into first and second curved portions 304*b* and 304*c*. One end of the second curved portion 304*c* remote from the vertical wall 11*a* is covered by a lid member 306, and one end portion of the shaft member 303 remote from the vertical wall 11*a* is supported by the lid member 306 by means of a catch member 307.

The lever member 305 referred to above has an operating portion 305*a* protruding axially outwardly from the end of the hollow bobbin body 304 remote from the vertical wall 11*a*, and two plate-shaped extensions 305*b* extending in a direction perpendicular to the operating portion 305*a*. A biasing spring 308 for biasing the lever member 305 towards the vertical wall 11*a* is interposed between the plate-shaped extensions 305*b* and the lid member 306.

The hexagonal portion 303*a* of the shaft member 303 is formed with a plurality of, for example, two through-holes

303*c* through which respective pin members 309 are passed with their ends received in associated guide grooves 305*c* defined in the plate-shaped extensions 305*b*.

Each of the guide grooves 305*c* defined in each of the plate-shaped extensions 305*b* is of a configuration having its opposite ends offset relative to each other with respect to the imaginary line parallel to the longitudinal sense of the shaft member 303. More specifically, the guide grooves 305*c* are so designed and so configured that when the lever member 305 is pulled against the biasing force of the biasing spring 308 in a direction away from the vertical wall 11*a* with a pulling force applied to the operating portion 305*a*, the lever member 305 can be guided by the pin members 309 then sliding along and within the associated guide grooves 305*c* to shift the lever member 305 in a direction close towards the second curved portion 304*c* as shown in FIG. 9, but when the lever member 305 is moved biased by the biasing force of the biasing spring 308 in a direction close towards the vertical wall 11*a*, the lever member 305 can be shifted in a direction close towards the first curved portion 304*b* as shown in FIG. 7.

Figure 9:
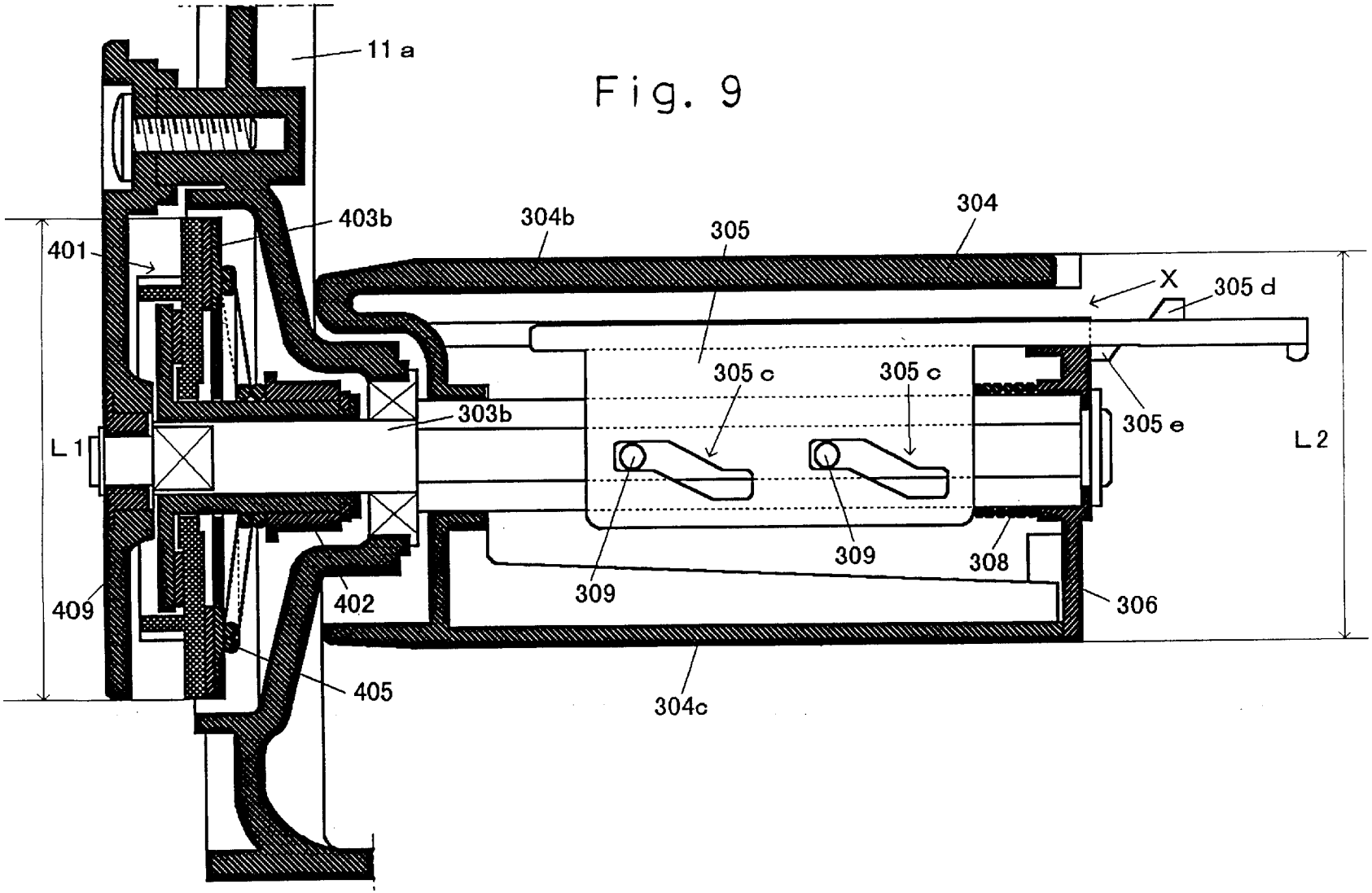
FIG. 9 is a longitudinal sectional view of the bobbin, showing how the bobbin is operated.

Thus, when the lever member 305 is shifted towards the first curved portion 304*b* as shown in FIG. 7, the lever member 305 can clamp the leading end of the ribbon of backing sheet Rb in cooperation with an inner wall surface 304*b*' of the first curved portion 304*b*, but when the lever member 305 is shifted towards the second curved portion 304*c* as shown in FIG. 9, a gap X is formed between the second curved portion 304*c* and the lever member 305 and, accordingly, the leading end of the ribbon of backing sheet Rb once clamped can be released in readiness for the subsequent clamping of a leading end of the ribbon of backing sheet Rb of the replaced label roll.

The lever member 305 supported in the manner described above is selectively movable between a clamp position shown in FIG. 7 and at which the leading end of the ribbon of backing sheet Rb can be clamped, and a release position shown in FIG. 9 and at which the leading end of the ribbon of backing sheet Rb then clamped can be released from the gap X or a leading end of a new ribbon of backing sheet can be inserted into the gap X. This lever member 305 is formed with a first projection 305*d* engageable in a recess 304*d*, that is defined in the end of the first curved portion 304*b* remote from the vertical wall 11*a*, when the lever member 305 is in the clamp position, and also with a second projection 305*e* engageable with the lid member 306 when the lever member 305 is in the release position. Accordingly, when the first projection 305*d* is engaged in the recess 304*d*, the lever member 305 can be locked at the clamp position and, on the other hand, when the second projection 305*e* is engaged with the lid member 305, the lever member 305 can be locked at the release position.

Figure 10:
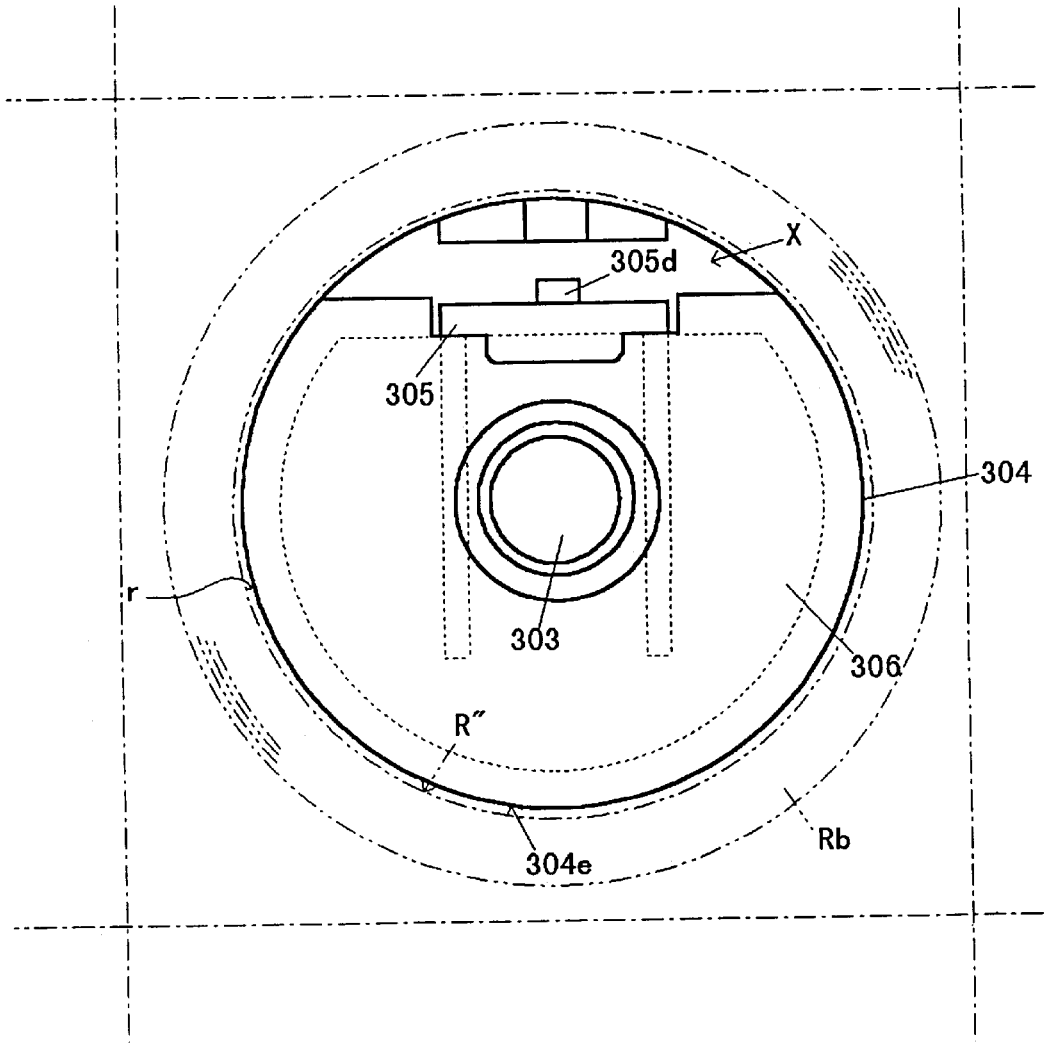
FIG. 10 is a front elevational view of the bobbin, showing how the bobbin is operated.

The hollow bobbin body 304 is made of a material having a resiliency and, therefore, when the lever member 305 is held in the release position, an end portion of the hollow bobbin body 304 remote from the vertical wall 11*a* can be radially inwardly deformed against its own resiliency. Accordingly, when the ribbon of backing sheet Rb wound around the bobbin 301 is to be removed from the bobbin 304, a clearance r as best shown in FIG. 10 can be formed between an outer periphery 304*e* of the hollow bobbin body 304 and the innermost turn R" of the wound ribbon of backing sheet Rb to thereby facilitate removal of a roll of backing sheet Rb, that is, the ribbon of backing sheet Rb wound around the bobbin 301, from the hollow bobbin body 304.

Thus, it will readily be seen that only the slide motion of the lever member 305 is sufficient to selectively clamp and release the leading end of the ribbon of backing sheet Rb. Accordingly, clamping of the leading end of the ribbon of backing sheet Rb and removal of the roll of backing sheet Rb from the bobbin 301 can readily be accomplished, resulting in increase of the workability.

It is to be noted that the hollow bobbin body 304 of the structure described hereinabove has no projection protruding outwardly from the outer periphery thereof and the ribbon of backing sheet Rb can be smoothly wound around the bobbin 301 and, accordingly, neither will the slide clutch 401 be adversely affected, nor the printing accuracy exhibited by the platen roll 202 will be deteriorated.

In addition, no element is provided that must be removed from the hollow bobbin body 304 at the time of release of the leading end of the ribbon of backing sheet Rb and, instead, it is sufficient to manipulate the lever member 305 supported on the shaft member 303 for this purpose. Accordingly, as compared with the use of the U-shaped pin member that is generally employed in the prior art apparatus and is apt to be lost, the present invention is substantially free from such a problem.

The slide clutch 401 referred to hereinbefore is used to transmit the drive from the electric drive motor to the bobbin 301 and is disposed around the cylindrical portion 303*b* of the shaft member 303, the details of which will now be described.

Figure 11:
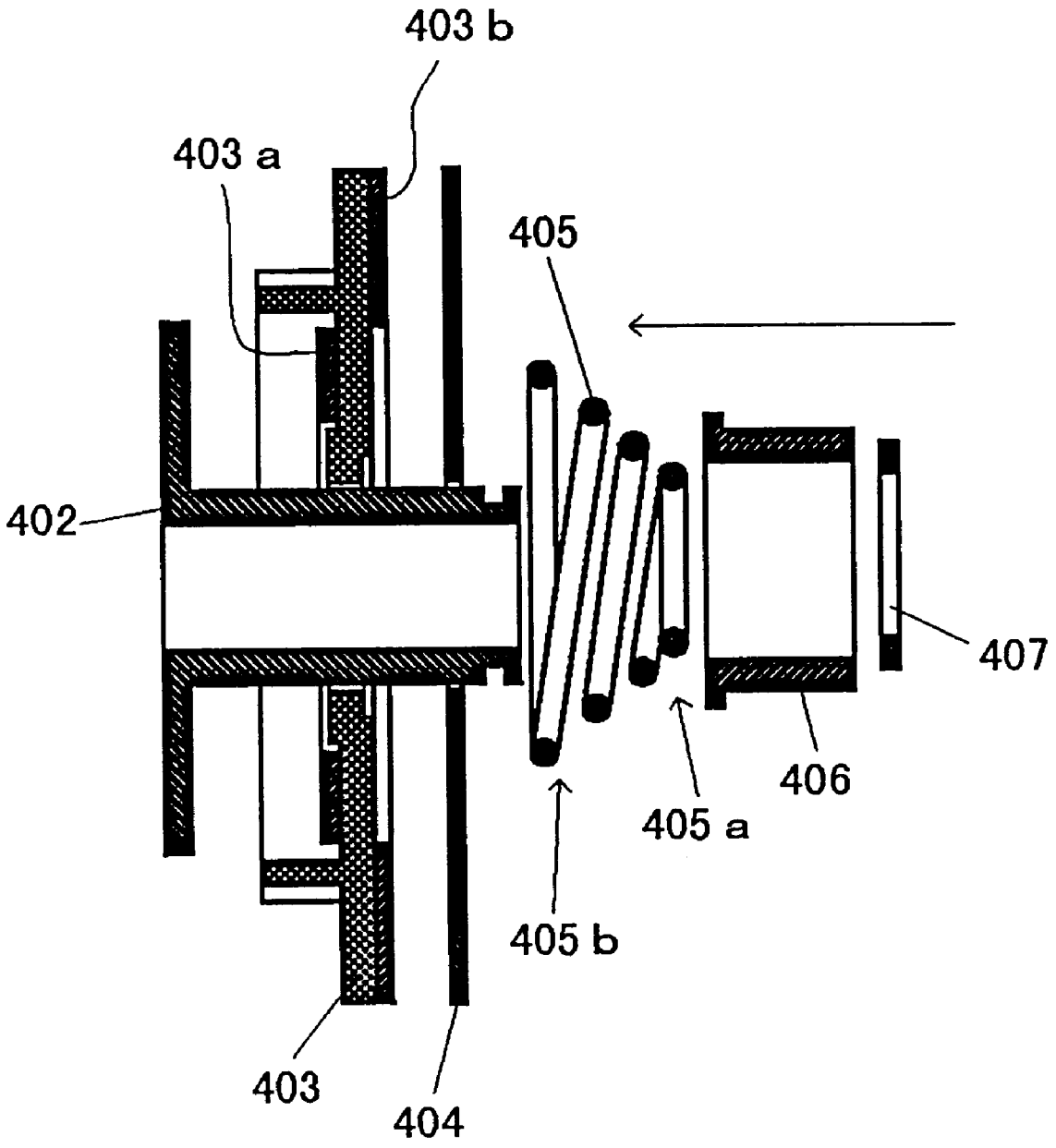
FIG. 11 is a side sectional view showing how the slide clutch is assembled.
Figure 12:
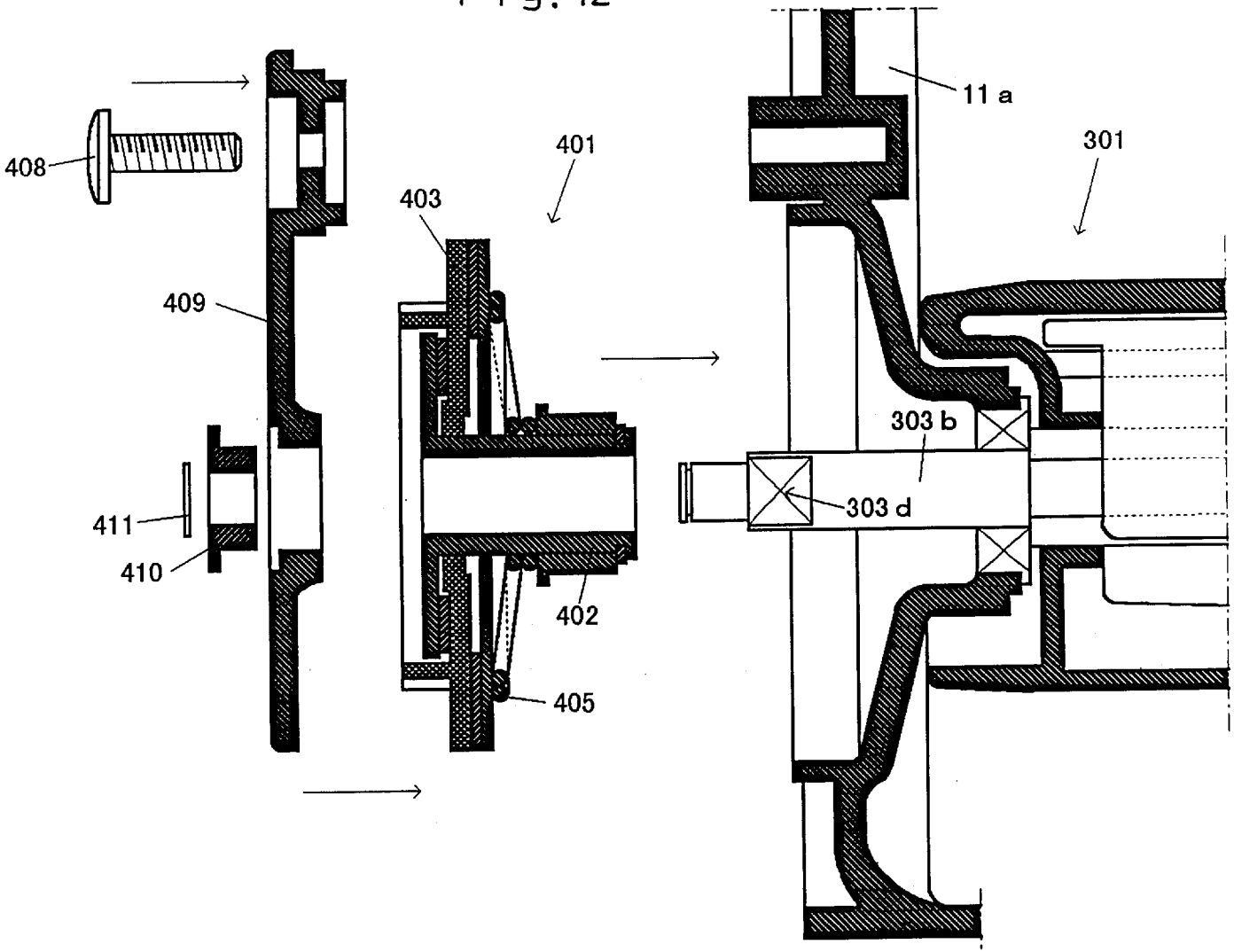
FIG. 12 is an exploded view, shown in section, showing the manner in which the slide clutch is mounted on a shaft member.

Referring now to FIG. 7, the slide clutch 401 includes a sleeve 402 having a radially outwardly extending flange 402*a*, a clutch disc 403 loosely mounted on the sleeve 402 and having its opposite surfaces to which respective facings 403*a* and 403*b* are bonded, a disc-shaped pusher plate 404 loosely mounted on the sleeve 402, a generally conical coil spring 405, a tubular stopper 406, and a generally C-shaped fixing member 407. The clutch disc 403, the pusher plate 404, the coil spring 405, the tubular stopper 406 and the fixing member 407 are disposed around the sleeve 402. Thus, after these elements 403 to 407 have been mounted and assembled around the sleeve 402 in a manner as shown in FIG. 11, the assembly of these elements 403 to 407 can be mounted on the shaft member 303 in a manner as shown in FIG. 12. Therefore, as compared with the case wherein elements like these elements 403 to 407 are mounted one by one onto the shaft member, assemblage at the site of the shaft member 303 can be considerably facilitated, resulting in increase of the mounting efficiency.

The clutch disc 403 has one surface formed with a gear portion 403*c* through which the drive can be transmitted to the clutch disc 403. The facing 403*a* bonded to the surface of the clutch disc 403 where the gear portion 403*c* is formed is brought into contact with the radially outwardly extending flange 402*a* of the sleeve 402. The facing 403*b* bonded to the opposite surface of the clutch disc 403 is held in contact with the pusher plate 404 and, by the action of the biasing force of the coil spring 405 that is interposed between the tubular stopper 406, positioned by the fixing member 407, and the pusher plate 404, the clutch disc 403 and the pusher plate 404 are urged towards the flange 402*a* of the sleeve 402. Accordingly, a frictional force of a predetermined magnitude is developed at a first frictional interface between the flange 402*a* and the facing 403*a* and also at a second frictional interface between the facing 403*b* and the pusher plate 404.

Thus, the provision of the facings (frictional surfaces) 403*a* and 403*b* on the respective opposite surfaces of the clutch disc 403 is effective to increase the surface area of frictional contact as compared with the case in which only one surface of the clutch disc is provided with a facing and, accordingly, even though the coil spring 405 is of a type exerting a relatively small biasing force, the desired frictional force can be obtained. Consequently, the use of the spring element having a relatively low elasticity is effective to increase the workability at the time of mounting of the spring.

Also, in such case, as shown in FIG. 9, the facing 403*b* has an outer diameter L1 chosen to be greater than the outer diameter L2 of the bobbin 301, so that for a similar reason to that described above the frictional force of a desired magnitude can be secured even though the coil spring 405 is of a type exerting a relatively small biasing force, thereby increasing the workability at the time of mounting of the coil spring 405.

As shown in FIG. 11, the coil spring 405 is of a generally conical shape having a reduced diameter portion 405*a* and a large diameter portion 405*b* opposite to the reduced diameter portion 405*a*. This coil spring 405 is adapted to be mounted around the sleeve 402 with the reduced diameter portion 405*a* oriented towards the tubular stopper 406 and with the large diameter portion 405*b* oriented towards the pusher plate 404. Accordingly, in an assembled condition as shown in FIG. 7, the reduced and large diameter portions 405*a* and 405*b* of the coil spring 405 are held in contact with the tubular stopper 406 and the pusher plate 404, respectively, with the pusher plate 404 consequently urged to frictionally contact the clutch disc 403.

The cylindrical portion 303*b* of the shaft member 303 is formed with cutouts 303*d*, only one of which is shown, and the sleeve 402 is formed with projections (not shown) engageable in the respective cutouts. Accordingly, when the sleeve 402 is mounted on the shaft member 303, the cutouts 303*d* receive therein the respective projection on the sleeve 402 so that the sleeve 402 can rotate together with the shaft member 303.

As shown in FIGS. 7 and 12, the slide clutch 401 mounted around the shaft member 303 is covered by a cover member 409 secured to the vertical wall 11*a* by means of one or more bolts 408. However, one end of the shaft member 303 adjacent the vertical wall 11*a* is rotatably fitted to the cover member 409 by means of a bearing 410 and a stop washer 411.

With the slide clutch 401 so constructed as hereinabove described, the drive transmitted to the clutch disc 403 through the gear portion 403*c* can be transmitted to the sleeve 402 through the facings 403*a* and 403*b* and then to the shaft member 303 rotatable together with the sleeve 402.

The drive transmission mechanism 400 for transmitting the drive from the electric drive motor (not shown) includes, as shown in FIG. 2, the slide clutch 401, a gear 420 for driving the platen roll 202, and an intermediate gear 421 meshed with the gear 420 and also with the gear portion 403*c* integral with the clutch disc 403 of the slide clutch 401. The intermediate gear 421 is again meshed with a gear portion M of a drive shaft of the electric drive motor. Accordingly, rotation of the gear portion M in a direction shown by the arrow A1 in FIG. 2 results in rotation of the intermediate gear 421 in a direction shown by the arrow A2 and, hence, rotation of gear 420 integral with the platen roll 202 in a direction shown by the arrow A3 and, also, rotation of the clutch disc 403 in a direction shown by the arrow A4.

Figure 13:
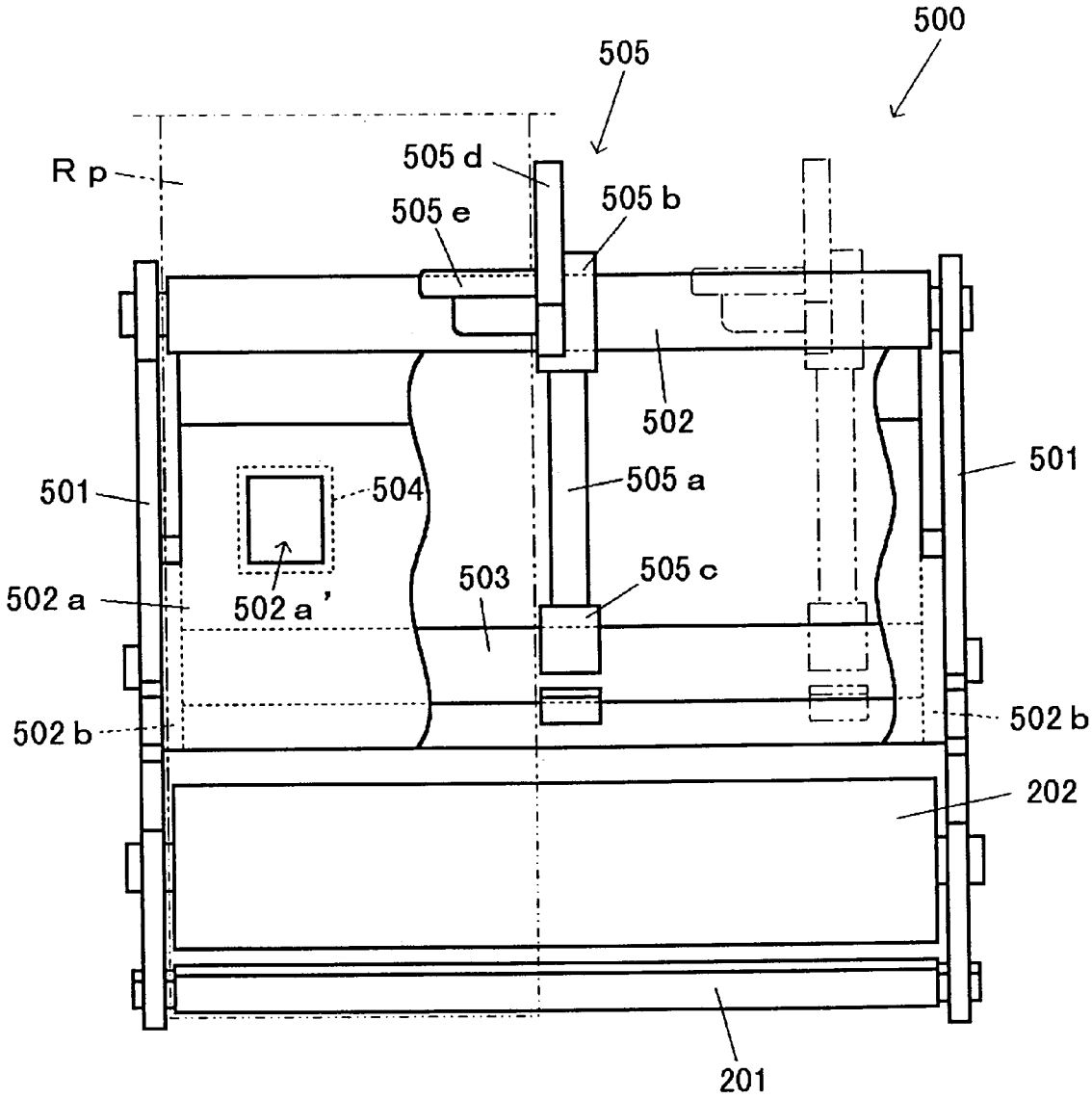
FIG. 13 is a plan view showing a mechanism for regulating a ribbon-shaped label carrier sheet.

A mechanism 500 is disposed between the roll supply unit 100 and the printer unit 200 for preventing some of outer turns of the label roll R of the label carrier ribbon Rp, that are successively drawn outwardly from the label roll R, from displacing laterally in a direction widthwise of the label carrier ribbon Rp and also for preventing such some of the outer turns of the label roll R from being floated relative to the remaining turns of the label roll R. As shown in FIGS. 2 and 13, a first shaft member 502 is disposed between the label supply unit 100 and the printer unit 200 and is supported by the vertical wall 11*a*. The mechanism 500 referred to above includes a label carrier ribbon regulating member 505 disposed on one of opposite ends of the first shaft member 502 and operable to engage one of opposite longitudinal edges of the label carrier ribbon Rp so that the label carrier ribbon regulating member 505 can cooperate with the vertical wall 11*a* to thereby avoid any possible lateral displacement of the label carrier ribbon Rp in a direction axially of the first shaft member 502. The label carrier ribbon regulating member 505 is provided with a label carrier ribbon suppressor 505*e* that extends in a direction towards the other end of the first shaft member 502 and is operable to prevent some of the outer turns of the label roll R from floating relative to the remaining turns of the label roll R and, accordingly, the label carrier ribbon Rp can easily passed to the printer unit 200.

Figure 19:
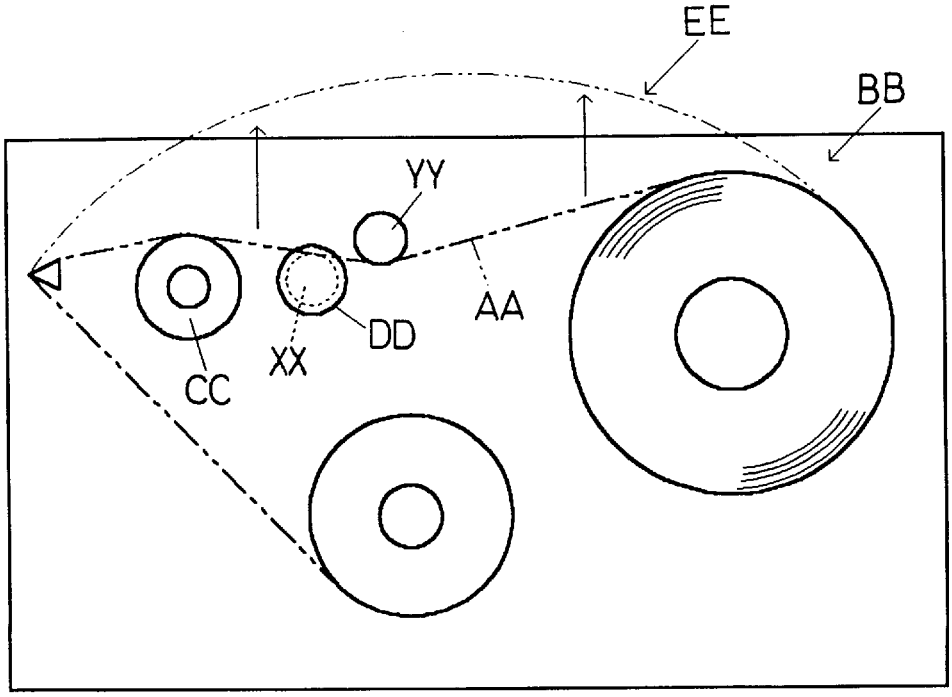
Fig. 19 Prior Art
FIG. 19 is a schematic diagram showing how the label carrier ribbon is regulated and how the label carrier ribbon is prevented from being floated according to the prior art.

In contrast thereto, in the prior art label printer, a mechanism for supporting a ribbon of label carrier sheet AA to ensure an assured transport thereof in a predetermined direction is disposed between a label supply unit BB and a platen roll CC and along a path of travel of the label carrier ribbon AA as shown in FIG. 19. This mechanism includes two shafts XX and YY extending parallel to each other and traversing the label carrier ribbon AA in a direction widthwise thereof. One of the shafts, that is, the shaft XX has one end provided with a regulating member DD of a diameter greater than that of the shaft XX for regulating the label carrier ribbon AA, then traveling in one direction, so as to avoid any possible lateral displacement thereof relative to the shaft XX to thereby ensure an assured transport of the label carrier ribbon AA in the direction of transport thereof.

On the other hand, when one of opposite side edges of the label carrier ribbon AA with respect to the direction of transport thereof is brought into abutment with the regulating member DD during the travel of the label carrier ribbon AA, it is often observed that a portion of the label carrier ribbon AA floats relative to the path of transport thereof as indicated by EE. Once this floating occurs, the regulating member DD often fails to ensure an assured transport of the label carrier ribbon A along the path of travel thereof. Accordingly, the other shaft YY is utilized to suppress the label carrier ribbon AA from being floated upwardly from the shaft XX.

Moreover, in order for this type of label printer to have a capability of issuing printed labels successively, the leading end of the label carrier ribbon drawn from the label roll has to be manually passed to the printing station. In such case, in the label printer of the type wherein as hereinabove described the shafts XX and YY are supported at one end by the vertical wall in a cantilever fashion, the attendant worker after the label roll has been loaded in the label supply unit has to hold one side edge of the label carrier ribbon, then pull it outwardly from the label roll so as to pass the label carrier ribbon underneath the shaft YY and then above the shaft XX, finally passing it in between the printer head and the platen roll.

In the label printer of the type wherein the shafts are supported in the cantilever fashion as hereinabove described, although a space may be available in the vicinity of the opposite end of the shafts XX and YY remote from the vertical wall for the attendant worker to perform the above described set-up job, the job requires utmost care to be taken and, hence, considerably time-consuming and laborious since the shafts XX and YY are positioned relatively close to each other so that the label printer as a whole can be assembled compact.

On the other hand, in a so-called double-end support design in which the shafts XX and YY have their opposite ends supported by respective vertical walls, the presence of the vertical walls one on each end of the shafts XX and YY will provide an obstruction and, therefore, the above described set-up job cannot be performed either side of the shafts XX and YY. As a result thereof, the set-up job of passing the label carrier ribbon beneath and above the shafts XX and YY, respectively, will become difficult to perform, accompanied by a substantial amount of difficulty.

In contrast to the prior label printers of the types discussed above, the label printer according to the present invention makes use of, as shown in FIGS. 2 and 13, support plates 501 each on one side of the label carrier ribbon Rp drawn from the label roll R for supporting first and second shaft members 502 and 503 therebetween. It is to be noted that the platen roll 202 and the peel-off rod 201 are also supported by and between the support plates 501.

As shown in FIG. 13, the first shaft member 502 has a plate-shaped sensor mount 502*a* formed therein so as to extend outwardly therefrom, and a sensor 504 for detecting passage of the label carrier ribbon Rp then traveling towards the printing station is fitted to a predetermined location on an undersurface of the sensor mount 502*a*. The sensor 504 detects the passage of the label carrier ribbon Rp through a sensing window 502*a*' defined in the sensor mount 502*a*. It is to be noted that the sensor mount 502*a* is fixed to the support plates 501 through respective fixtures 502*b*.

The label carrier ribbon regulating member 505 is used and mounted on the first and second shaft members 502 and 503. This regulating member 505 includes an elongated body 505*a* having ends opposite to each other, a generally C-shaped first grip 505*b* formed integrally with one end of the elongated body 505*a* and mounted on the first shaft member 502, a similarly generally C-shaped second grip 505*c* formed integrally with the opposite end of the elongated body 505*a* and mounted on the second shaft member 503, an upright lug 505*d* formed on the first grip 505*b* so as to protrude perpendicular thereto, and a label carrier ribbon suppressor 505*e* of a generally L-shaped configuration extending from the upright lug 505*d* to the vertical wall 11*a*.

The label carrier ribbon Rp drawn outwardly from the label roll R is, when the leading end of the label carrier ribbon Rp is to be passed towards the printer unit 200, passed through a gap T between the first shaft member 502 and the label carrier ribbon suppressor 505*e*. Accordingly, any possible lateral displacement of the label carrier ribbon Rp can be regulated by a wall surface 505*d*' of the upright lug 505*d* confronting with the vertical wall 11*a* while any possible float of the label carrier ribbon Rp can be suppressed by a surface, indicated by the arrow A10, of the label carrier ribbon suppressor 505*e*.

In view of the above, no considerably time-consuming and laborious job of passing the end of the label carrier ribbon in a tortuous fashion above and beneath a plurality of shafts such as required in the prior art label printers discussed hereinbefore is no longer required in the practice of the present invention and, therefore, the label carrier ribbon Rp drawn outwardly from the label roll R can be efficiently and easily passed towards the printer unit 200, accompanied by increase of the workability.

Although in the prior art label printers at least two shaft members are required to prevent the label carrier ribbon from undergoing a lateral displacement and also to prevent the label carrier ribbon from floating relative to the shaft members, the use of the label carrier ribbon regulating member 505 in the practice of the present invention has brought about an advantage of using the single shaft member 502, resulting in simplification of the structure of the label printer.

Figure 14:
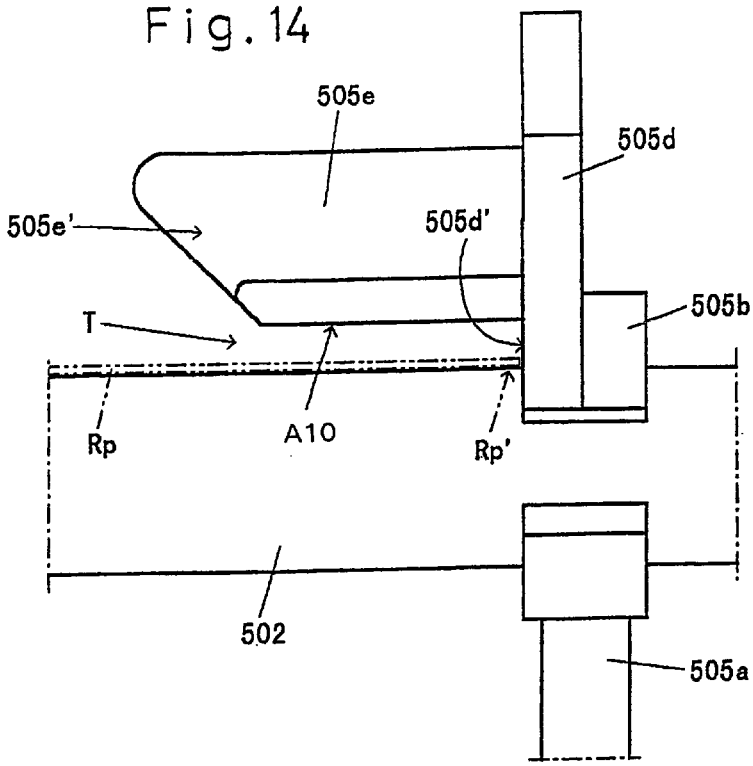
FIG. 14 is a diagram, on an enlarged scale, showing a first engagement and its neighborhood of a label position regulating member.

As shown in FIG. 14, one end 505*e*' of the label carrier ribbon suppressor 505*e* adjacent the vertical wall 11*a* is so formed and so shaped as to define a large gap between it and the first shaft member 502. Accordingly, when the side edge Rp' of the label carrier ribbon Rp is to be inserted into the gap T, the side edge Rp' of the label carrier ribbon Rp will hardly be caught by and will easily be passed clear of the end 505*e*' of the label carrier ribbon suppressor 505*e*. Thus, the insertion of the side edge Rp' of the label carrier ribbon Rp into the gap T can easily and smoothly be achieved, resulting in increase of the workability.

The label carrier ribbon regulating member 505 is made of a material having a resiliency so that the first and second grips 505*b* and 505*c* thereof can resiliently grip the first and second shaft members 502 and 503, respectively. Accordingly, the label ribbon carrier regulating member 505 can slide along the respective first and second shaft members 502 and 503 in a direction axially thereof so that the regulating member 505 can be repositioned according to the width of the label carrier ribbon Rp and, hence, the axial length of the label roll R. Also, not only can the regulating member 505 be resiliently retained at the position to which it has been repositioned to regulate the label carrier ribbon Rp with respect to the path of travel thereof, but also a relatively large force sufficient to overcome the resilient force with which each grip 505*b* and 505*c* grips the associated shaft member 502 and 503 is needed to slide the regulating member 505 along the first and second shaft members 502 and 503. Accordingly, the label carrier ribbon regulating member 505 will not displace arbitrarily along the first and second shaft members 502 and 503 once it has been set to a predetermined or required position.

As hereinbefore described, the label carrier ribbon regulating member 505 has its opposite ends mounted on the first and second shaft members 502 and 503, respectively, through the corresponding grips 502*b* and 502*c*. Since the first and second shaft members 502 and 503 are connected at one end to the vertical wall 11*a*, the first grip 505*b* mounted on the first shaft member 502, the elongated body 505*a* and the second grip 505*c* mounted on the second shaft member 503 serve as a rotation disabling means for preventing the label carrier ribbon regulating member 505 from rotating about either one of the first and second shaft members 502 and 503. By this provision of the rotation disabling means, it is possible to avoid the possibility that when, for example, the first shaft member 502 rotates about its own longitudinal axis, the label carrier ribbon regulating member 505 may rotate pursuit of rotation of the first shaft member 502. Therefore, the problem associated with entanglement of the label carrier ribbon Rp around the first shaft member 502 can advantageously be eliminated, which would otherwise occur when the first shaft member 502 may rotate accompanied by rotation of the label carrier ribbon regulating member 505 while the label carrier ribbon Rp is passed in between the first shaft member 502 and the label carrier ribbon regulating member 505.

Figure 15:
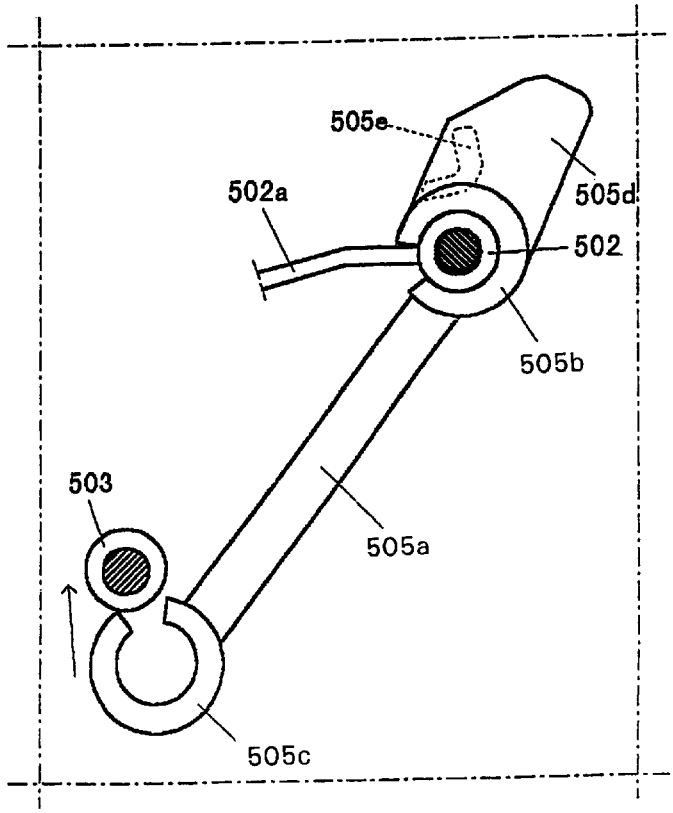
FIG. 15 is a diagram showing the manner in which the label position regulating member is fitted to the shaft member.

Also, as hereinbefore described, the label carrier ribbon regulating member 505 is made of a material having a resiliency and the opposite ends thereof are so shaped and so configured as to define the generally C-shaped first and second grips 505*b* and 505*c*. Accordingly, even after the first and second shaft members 502 and 503 have been mounted on the support plates 501 with their opposite ends secured thereto as shown in FIG. 15, the label carrier ribbon regulating member 505 can be mounted with the first and second grips 505*b* and 505*c* gripping the first and second shaft members 502 and 503, respectively, thereby resulting in increase of the fitting workability.

Thus, although the support plates 501 are disposed on respective sides of the first shaft member 502, mounting of the label carrier ribbon regulating member 505 on the shaft member 502 is effective to facilitate passage of the label carrier ribbon Rp towards the printer unit 200.

As hereinbefore described, since the roll retaining lever 103 disposed inside the roll supply unit 100 is mounted on the slide member 102, slidably inserted within the hollow of the roll holder 101, for pivotal movement between the erected and folded positions, the label roll R can be quickly and easily mounted onto the roll holder 101, resulting in increase of the efficiency with which such mounting is performed.

Also, since the roll retaining lever 103 when in the folded position lies parallel to the axial direction of the roll holder 101 so that the roll retaining lever 103 will not bar against mounting of the label roll R onto the roll holder 101, the free end 103*a* of the roll retaining lever 103 can protrude a substantial distance outwardly from the point of pivot 103*b* thereof. Accordingly, the label roll R of a relatively large radius can be mounted on the roll holder 101 with no possibility of some of the outer turns of the label roll R left unrestrained while protruding outwardly from the free end 103*a* of the roll retaining lever 103. In addition, even though the label carrier ribbon Rp floats radially outwardly of the label roll R, that is, is radially outwardly loosened from the label roll R at the time the label carrier ribbon Rp is drawn outwardly from the label roll R, the outermost turn of the label roll R that has floated will not ride over the roll retaining lever 103 and will not therefore depart from the remaining turns of the label roll R.

Moreover, since when the roll retaining lever 103 is held in the erected position, the opposite end 103*c* thereof is brought into contact with the inner wall surface 101*d* of the roll holder 101, the erected roll retaining lever 103 can be locked at the erected position assuredly. Accordingly, any possible displacement of the roll retaining lever 103 from the position where it ought to be to retain the label roll R on the roll holder 101 can be avoided advantageously, which would otherwise occur if the roll retaining lever 103 while held in the erected position undergoes an arbitrary movement.

Also, since the slide member 102 is slidable, the erected position to which the roll retaining lever 103 along the length of the roll holder 101 can be moved can be adjusted according to the axial length of the label roll R.

Furthermore, since the arrow-shaped marking 104*d* is formed in the roll retaining lever 103, frequent adjustment of the roll retaining lever 103 which is required each time the position at which the roll retaining lever 101 is to be erected displaces can advantageously be eliminated, and the position at which the roll retaining lever 101 is to be erected along the length of the roll holder 101 can be grasped at a single sight, resulting in increase of the workability.

Figure 16:
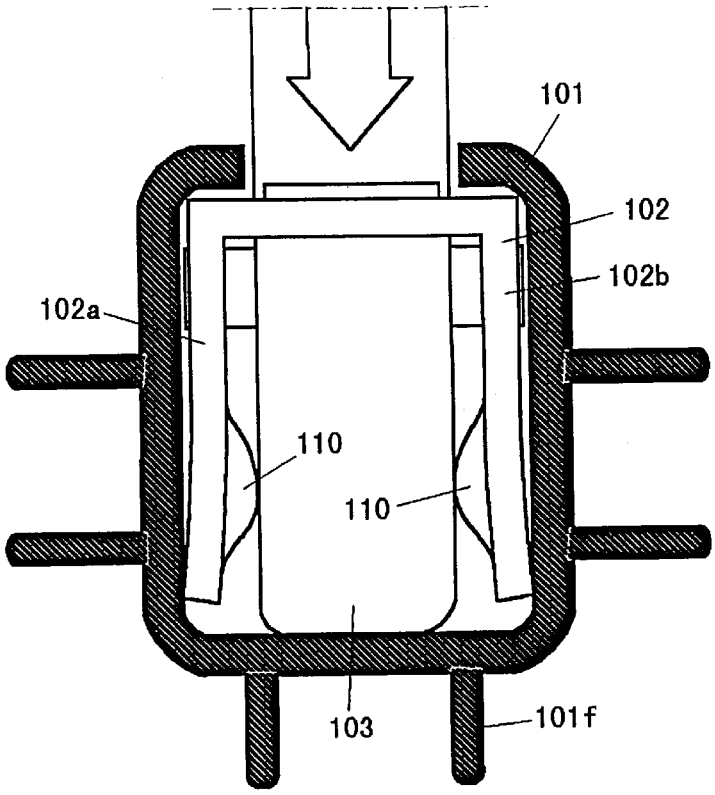
FIG. 16 is a sectional view, on an enlarged scale, showing a second preferred embodiment of the present invention.
Figure 17:
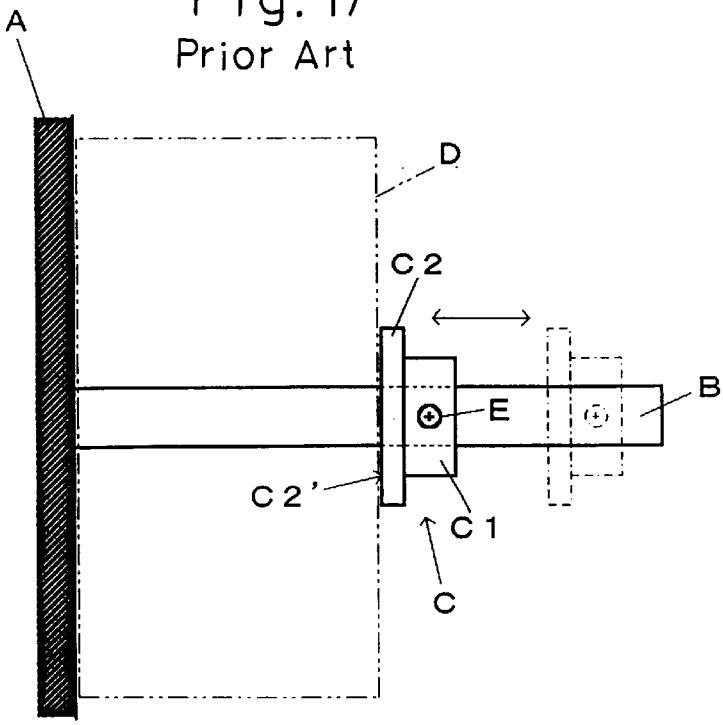
Fig. 17 Prior Art
FIG. 17 is a schematic longitudinal view of the roll holder employed in the prior art label printer.
Figure 18:
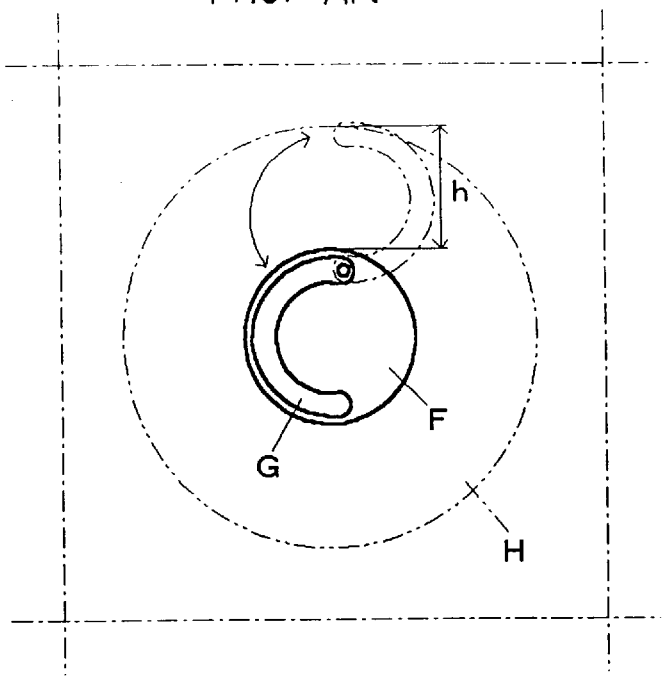
Fig. 18 Prior Art
FIG. 18 is a schematic end view of the different roll holder employed in the different prior art label printer.

FIG. 16 illustrates a second preferred embodiment of the present invention. In this second embodiment shown therein, protuberances 110 engageable with the roll retaining lever 103 when the latter is in the erected position are formed on inner wall surfaces of the first and second side walls 102*a* and 102*b*, respectively, so that when the first and second protuberances 110 are brought into engagement with the roll retaining lever 103 as a result of pivot of the roll retaining lever 103 to the erected position, the first and second side walls 102*a* and 102*b* of the slide member 102 are outwardly expanded against their own resiliency to allow the first and second side walls 102*a* and 102*b* to engage the opposite inner wall surface portions of the roll holder 101. Even this design effectively allows the roll retaining lever 103 to be locked at the erected position and, therefore, as is the case with the foregoing first embodiment of the present invention, arbitrary movement of the roll retaining lever 103 being erected can advantageously be eliminated and, therefore, any possible arbitrary displacement of the position at which the roll regulating lever 103 ought to be to regulate the label roll R on the roll holder 101 can be eliminated.

In addition, in the design in which when the roll retaining lever 103 is erected, the end 103*c* of the roll retaining lever

103*c* is brought into contact with the inner wall surface 101*d* of the roll holder 101, a reactive force will be transmitted from the roll holder 101 to the roll retaining lever 103, causing the slide member 102 to move within the hollow of the roll holder 101. However, the provision of the protuberances 110 as described above is effective to fix the slide member 102 in position within the hollow of the roll holder 101 and, consequently, any undesirable movement of the roll retaining lever 103 within the hollow of the roll holder 101 can advantageously be suppressed.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A label printer to print predetermined data on and to issue labels, said label printer comprising:

a roll support shaft to mount a roll of ribbon-shaped label sheet thereon, said roll support shaft having a hollow defined therein and a slot defined in communication with the hollow;

a slide member accommodated within the hollow of the roll support shaft; and a lever member connected to the slide member for pivotal movement between folded and erected positions relative to the roll support shaft, said lever member being connected to the slide member at a pivot point located within the hollow of the roll support shaft.

2. The label printer as claimed in claim 1, wherein said lever member when in the folded position lies substantially within the hollow of the roll support shaft.

3. The label printer as claimed in claim 1, the slide member having a thickened wall portion engaging with a side face of an opposite end portion of the lever member when the lever member is pivoted to the erected position, said thickened wall portion when brought into engagement with the side face of the opposite end portion of the lever member expanding the slide member to bring an outer wall face of the slide member into contact with an inner wall surface of the roll support shaft to thereby lock the lever member at the erected position.

4. A label printer for printing predetermined data on and issuing labels, said label printer comprising:

a roll supply unit adapted to accommodate a roll of ribbon-shaped label sheet;

a vertical wall disposed along and perpendicular to a predetermined path of travel of a ribbon of label sheet drawn outwardly from the roll in the roll supply unit;

a tubular roll support shaft having a hollow defined therein and connected to the vertical wall so as to extend perpendicular thereto, said roll support shaft having a slot defined therein in communication with the hollow thereof;

a slide member movably accommodated within the hollow of the roll support shaft for movement in a direction axially of the roll support shaft; and a lever member connected to the slide member for pivotal movement about a point of pivot between folded and erected positions relative to the roll support shaft, wherein said lever member when in the erected position has one end portion protruding outwardly from the hollow of the roll support shaft through the slot, to thereby retain the roll of the ribbon-shaped label sheet in position on the roll support shaft to avoid any possible lateral displacement thereof, but said lever member when in the folded position lies substantially parallel to a longitudinal axis of the roll support shaft to allow the roll of the ribbon-shaped label sheet to be mounted onto the roll support shaft, and the slide member has side walls opposite to each other and has a slit defined in each of the side walls so as to extend away from the vertical wall, said slit in each of the side walls dividing a corresponding side wall into two wall segments, at least one of said wall segments having a resiliency, said at least one of the wall segments being formed with a projection for urging an inner wall surface of the roll support shaft whereby when the slide member slides within the hollow of the roll support shaft, a slide resistance of a predetermined magnitude is developed between the projection and the inner wall surface of the roll support shaft.

5. A label printer for printing predetermined data on and issuing labels, said label printer comprising:

a roll supply unit adapted to accommodate a roll of ribbon-shaped label sheet;

a vertical wall disposed along and perpendicular to a predetermined path of travel of a ribbon of label sheet drawn outwardly from the roll in the roll supply unit;

a tubular roll support shaft having a hollow defined therein and connected to the vertical wall so as to extend perpendicular thereto, said roll support shaft having a slot defined therein in communication with the hollow thereof;

a slide member movably accommodated within the hollow of the roll support shaft for movement in a direction axially of the roll support shaft; and a lever member connected to the slide member for pivotal movement about a point of pivot between folded and erected positions relative to the roll support shaft, wherein said lever member when in the erected position has one end portion protruding outwardly from the hollow of the roll support shaft through the slot, to thereby retain the roll of the ribbon-shaped label sheet in position on the roll support shaft to avoid any possible lateral displacement thereof, but said lever member when in the folded position lies substantially parallel to a longitudinal axis of the roll support shaft to allow the roll of the ribbon-shaped label sheet to be mounted onto the roll support shaft, and the slide member including a third wall disposed between opposite side walls thereof, said third wall having two parallel slits defined therein so as to extend in a direction inwardly thereof and away from the vertical wall, said slits defining an isolated portion discontinued from the opposite side walls thereof, said isolated portion having a resiliency; and wherein said isolated portion having an outer surface formed with an engagement protruding outwardly therefrom, said engagement engaging one end of the slot in the roll support shaft adjacent the vertical wall after the single lever unit is mounted into the hollow of the roll support shaft, to thereby retain the single lever unit therein while being prevented from detachment out of the hollow by means of the engagement engaged with the end of the slot in the roll support shaft adjacent the vertical wall.

6. A label printer for printing predetermined data on and issuing labels, said label printer comprising:

a roll supply unit to accommodate a roll of ribbon-shaped label sheet;

a vertical wall disposed along and perpendicular to a predetermined path of travel of a ribbon of label sheet drawn outwardly from the roll in the roll supply unit;

a tubular roll support shaft having a hollow defined therein and connected to the vertical wall so as to extend perpendicular thereto, said roll support shaft having a slot defined therein in communication with the hollow thereof;

a slide member accommodated within the hollow of the roll support shaft for movement in a direction axially of the roll support shaft; and a lever member connected to the slide member for pivotal movement about a point of pivot between folded and erected positions relative to the roll support shaft, said lever member when in the erected position having one end portion protruding outwardly from the hollow of the roll support shaft through the slot, to thereby retain the roll of the ribbon-shaped label sheet in position on the roll support shaft to avoid any possible lateral displacement thereof, but said lever member when in the folded position lying substantially parallel to a longitudinal axis of the roll support shaft to allow the roll of the ribbon-shaped label sheet to be mounted onto the roll support shaft, said lever member having an opposite end portion extending away from the point of pivot in a direction counter to said one end portion thereof such that when the lever member is pivoted to the erected position, said opposite end portion of the lever member is brought into engagement with an inner wall surface of the roll support shaft to thereby lock the lever member at the erected position.

7. The label printer as claimed in claim 6, the lever member having an index marking alignable with one end face of the roll of the ribbon-shaped label sheet when the roll is mounted on the roll support shaft, to thereby indicate a position of the lever member at which the lever member is pivoted to the erected position to retain the roll in position on the roll support shaft.

8. The label printer as claimed in claim 6, the lever member and the slide member being integrally assembled into a single lever unit such that the lever member and the slide member are mounted inside the roll support shaft by inserting the lever unit axially into the hollow of the roll support shaft.

* * * * *

UNITED STATES PATENT AND TRADEMARK OFFICE

CERTIFICATE OF CORRECTION

PATENT NO. : 6,336,757 B1
DATED : January 8, 2002
INVENTOR(S) : Hiromu Nishimura et al.

It is certified that error appears in the above-identified patent and that said Letters Patent is hereby corrected as shown below:

Title page,
Item [75], Inventors, change "Shiga" to -- Kurita --.

Item [57], ABSTRACT,
Line 6, change "102for" to -- 102 for --.

Column 9,
Line 24, change "1a" to -- 11a --.

Column 11,
Line 31, insert -- , -- after "position".
Line 35, insert -- , -- after "invention".

Column 12,
Line 35, insert -- . -- after "thereof".

Signed and Sealed this

Thirteenth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,336,757 B1
DATED : January 8, 2002
INVENTOR(S) : Hiromu Nishimura et al.

It is certified that error appears in the above-identified patent and that said Letters Patent is hereby corrected as shown below:

Title page,
Item [75], Inventors, change "Kurita" to -- Shiga --.

Signed and Sealed this

Twenty-first Day of January, 2003

JAMES E. ROGAN
*Director of the United States Patent and Trademark Office*